US010104741B2

(12) United States Patent
Choi et al.

(10) Patent No.: US 10,104,741 B2
(45) Date of Patent: Oct. 16, 2018

(54) LED DRIVING APPARATUS, LIGHTING APPARATUS INCLUDING THE SAME, AND METHOD OF DRIVING LED MODULE

(71) Applicant: Samsung Electronics Co., Ltd., Suwon-si (KR)

(72) Inventors: Seung-kwan Choi, Suwon-si (KR); Min-su Kim, Ansan-si (KR)

(73) Assignee: SAMSUNG ELECTRONICS CO., LTD., Samsung-ro, Yeongtong-gu, Suwon-si, Gyeonggi-do (KR)

( * ) Notice: Subject to any disclaimer, the term of this patent is extended or adjusted under 35 U.S.C. 154(b) by 0 days.

(21) Appl. No.: 15/670,331

(22) Filed: Aug. 7, 2017

(65) Prior Publication Data

US 2018/0242422 A1 Aug. 23, 2018

(30) Foreign Application Priority Data

Feb. 17, 2017 (KR) ..... 10-2017-0021852

(51) Int. Cl.
*H05B 37/02* (2006.01)
*H05B 33/08* (2006.01)

(52) U.S. Cl.
CPC ..... *H05B 33/0857* (2013.01); *H05B 33/0818* (2013.01); *H05B 33/0842* (2013.01); *H05B 33/0845* (2013.01)

(58) Field of Classification Search
CPC ..... H05B 33/0833; H05B 33/0845; H05B 33/0857; H05B 33/086
USPC ..... 315/185 R, 291, 307
See application file for complete search history.

(56) References Cited

U.S. PATENT DOCUMENTS

| | | | |
|---|---|---|---|
| 6,372,608 | B1 | 4/2002 | Shimoda et al. |
| 6,645,830 | B2 | 11/2003 | Shimoda et al. |
| RE38,466 | E | 3/2004 | Inoue et al. |
| 6,818,465 | B2 | 11/2004 | Biwa et al. |
| 6,818,530 | B2 | 11/2004 | Shimoda et al. |
| 6,858,081 | B2 | 2/2005 | Biwa et al. |
| 6,967,353 | B2 | 11/2005 | Suzuki et al. |
| 7,002,182 | B2 | 2/2006 | Okuyama et al. |
| 7,084,420 | B2 | 8/2006 | Kim et al. |
| 7,087,932 | B2 | 8/2006 | Okuyama et al. |

(Continued)

FOREIGN PATENT DOCUMENTS

| | | |
|---|---|---|
| JP | 2014-078374 | 1/2014 |
| JP | 2016-154154 | 8/2016 |

*Primary Examiner* — Thuy Vinh Tran
(74) *Attorney, Agent, or Firm* — Muir Patent Law, PLLC

(57) ABSTRACT

A light-emitting diode (LED) driving apparatus driving an LED module includes: a first output circuit configured to supply a first driving current to a first LED array; a second output circuit configured to supply a second driving current to a second LED array; and a controller configured to transmit a first control signal and a second control signal respectively to the first output circuit and the second output circuit, wherein the controller is further configured to control the LED module based on the first input signal so that a color temperature of the LED module has a value between a first color temperature and a second color temperature, to control brightness of the LED module based on the second input signal, and includes a lookup table including information about the first control signal and the second control signal respectively corresponding to the first input signal and the second input signal.

14 Claims, 15 Drawing Sheets

(56) References Cited

U.S. PATENT DOCUMENTS 7,154,124 B2 12/2006 Han et al.
7,173,383 B2 * 2/2007 Vornsand ..... H05B 33/0869 315/291
7,208,725 B2 4/2007 Sherrer et al.
7,288,758 B2 10/2007 Sherrer et al.
7,319,044 B2 1/2008 Han et al.
7,501,656 B2 3/2009 Han et al.
7,709,857 B2 5/2010 Kim et al.
7,759,140 B2 7/2010 Lee et al.
7,781,727 B2 8/2010 Sherrer et al.
7,790,482 B2 9/2010 Han et al.
7,940,350 B2 5/2011 Jeong
7,959,312 B2 6/2011 Yoo et al.
7,964,881 B2 6/2011 Choi et al.
7,985,976 B2 7/2011 Choi et al.
7,994,525 B2 8/2011 Lee et al.
8,008,683 B2 8/2011 Choi et al.
8,013,352 B2 9/2011 Lee et al.
8,040,075 B2 10/2011 Horino et al.
8,049,161 B2 11/2011 Sherrer et al.
8,129,711 B2 3/2012 Kang et al.
8,179,938 B2 5/2012 Kim
8,263,987 B2 9/2012 Choi et al.
8,324,646 B2 12/2012 Lee et al.
8,399,944 B2 3/2013 Kwak et al.
8,432,511 B2 4/2013 Jeong
8,459,832 B2 6/2013 Kim
8,502,242 B2 8/2013 Kim et al.
8,536,604 B2 9/2013 Kwak et al.
8,766,295 B2 1/2014 Kim
8,735,931 B2 5/2014 Habeeb et al.
8,823,289 B2 9/2014 Linz et al.
8,952,627 B2 2/2015 Tomiyama et al.
9,374,860 B2 6/2016 Kadotani et al.
2014/0035472 A1 * 2/2014 Raj ..... H05B 33/0863 315/185 R
2015/0351169 A1 * 12/2015 Pope ..... H05B 33/086 315/193
2016/0150616 A1 5/2016 Bell et al.
2016/0309561 A1 10/2016 Hamilton et al.

* cited by examiner

111_1

| IN_1C | CCT | DUTY RATIO_1 | DUTY RATIO_2 |
|---|---|---|---|
| 0V~2V | 2700K | 100% | 0% |
| 2V~4V | 3000K | 70% | 30% |
| 4V~5V | 3500K | 60% | 40% |
| 5V~6V | 4000K | 50% | 50% |
| 6V~8V | 5000K | 40% | 60% |
| 8V~10V | 6500K | 0% | 100% |

* FIRST LED ARRAY: 2700K, SECOND LED ARRAY: 6500K

111_2

| IN_2D | DIM LEVEL |
|---|---|
| 0V~2V | 0% |
| 2V~4V | 20% |
| 4V~5V | 40% |
| 5V~6V | 60% |
| 6V~8V | 80% |
| 8V~10V | 100% |

FIG. 9A

111_1a

| IN_1C | CCT | DUTY RATIO_1 | DUTY RATIO_2 |
|---|---|---|---|
| 0V~2V | 2700K | 100% | 0% |
| 2V~4V | 3000K | 0% | 0% |
| 4V~5V | 3500K | 60% | 40% |
| 5V~6V | 4000K | 0% | 0% |
| 6V~8V | 5000K | 40% | 60% |
| 8V~10V | 6500K | 0% | 100% |

* FIRST LED ARRAY: 2700K, SECOND LED ARRAY: 6500K

FIG. 9B

111_1a'

| IN_1C | CCT | DUTY RATIO_1 | DUTY RATIO_2 |
|---|---|---|---|
| 0V~3V | 2700K | 100% | 0% |
| | 3000K | 70% | 30% |
| 3V~5V | 3500K | 60% | 40% |
| | 4000K | 50% | 50% |
| 5V~8 | 5000K | 40% | 60% |
| 8V~10V | 6500K | 0% | 100% |

* FIRST LED ARRAY: 2700K, SECOND LED ARRAY: 6500K

111_1b

| IN_1C | CCT | DUTY RATIO_1 | DUTY RATIO_2 |
|---|---|---|---|
| 0V~2V | 3000K | 100% | 0% |
| 2V~5V | 3500K | 70% | 30% |
| 5V~7V | 4000K | 50% | 50% |
| 7V~10V | 5000K | 0% | 100% |

* FIRST LED ARRAY: 3000K, SECOND LED ARRAY: 5000K

LED DRIVING APPARATUS, LIGHTING APPARATUS INCLUDING THE SAME, AND METHOD OF DRIVING LED MODULE

CROSS-REFERENCE TO RELATED APPLICATION

This application claims the benefit of priority under 35 U.S.C. 119 to Korean Patent Application No. 10-2017-0021852, filed on Feb. 17, 2017, in the Korean Intellectual Property Office, the disclosure of which is incorporated herein in its entirety by reference.

BACKGROUND

The present disclosure relates to a light-emitting diode (LED) driving apparatus, a lighting apparatus including the LED driving apparatus, and a method of driving an LED module, and more particularly, to an LED driving apparatus capable of controlling color temperature and brightness of an LED module, a lighting apparatus including the LED driving apparatus, and a method of driving an LED.

An LED is a semiconductor light-emitting element that has advantages such as lower power consumption, longer lifetime, and realization of various colors compared to other light sources such as fluorescent light and an incandescent light. Based on these advantages, LEDs are widely used in various lighting devices.

The lighting apparatuses which include LEDs and provide various color temperatures and brightness have been developed. Since the color temperature of the lighting apparatuses is determined in accordance with the characteristics of light sources, controlling the color temperature in the lighting apparatuses may be difficult. In addition, as the usage environment of the lighting apparatuses has been diversified, controlling the color temperature and the brightness of the lighting apparatuses may be needed.

SUMMARY

The present disclosure provides a light-emitting diode (LED) driving apparatus capable of easy controlling of color temperature and brightness of an LED module, a lighting apparatus including the LED driving apparatus, and a method of driving the LED.

According to an aspect of the present disclosure, there is provided an LED driving apparatus driving an LED module including a first LED array and a second LED array respectively having a first color temperature and a second color temperature, the LED driving apparatus including: a first output circuit configured to supply a first driving current to the first LED array; a second output circuit configured to supply a second driving current to the second LED array; and a controller including a lookup table that includes information about a first control signal corresponding to a first input signal and information about a second control signal corresponding to a second input signal, wherein the controller is configured to receive the first input signal and the second input signal from the outside of the LED driving apparatus, and to transmit the first control signal to the first output circuit and the second control signal to the second output circuit based on the lookup table, and the controller is configured to control the LED module based on the first input signal so that color temperature of the LED module has a value between the first color temperature of the first LED array and the second color temperature of the second LED array, and to control brightness of the LED module based on the second input signal.

According to another aspect of the present disclosure, there is provided a lighting apparatus including: an LED module including a first LED array having a first color temperature and a second LED array having a second color temperature different from the first color temperature; and an LED driving apparatus configured to supply a first driving current to the first LED array and to supply a second driving current to the second LED array, wherein the LED driving apparatus is configured to receive a first input signal and a second input signal from the outside of the LED driving apparatus, to control a color temperature of the LED module to have a value between the first color temperature and the second color temperature based on the first input signal, and to control brightness of the LED module based on the second input signal.

According to another aspect of the present disclosure, there is provided a method of driving an LED module including a first LED array having a first color temperature and a second LED array having a second color temperature different from the first color temperature, the method of driving the LED including: receiving a first input signal; and controlling color temperature of the LED module between the first color temperature and the second color temperature based on the first input signal while maintaining brightness of the LED module, wherein the controlling the color temperature of the LED module includes controlling the color temperature of the LED module based on a lookup table included in an LED driving apparatus.

According to another aspect of the present disclosure, there is provided a method of driving an LED module including a first LED array having a first color temperature and a second LED array having a second color temperature different from the first color temperature, the method of driving the LED module including: storing, into a lookup table included in an LED driving apparatus, information about a first control signal corresponding to a first input signal and information about a second control signal corresponding to a second input signal; receiving the first input signal; generating the first control signal and the second control signal based on the lookup table; and controlling the LED module based on the first input signal so that color temperature of the LED module has a value between the first color temperature of the first LED array and the second color temperature of the second LED array while maintaining brightness of the LED module.

BRIEF DESCRIPTION OF THE DRAWINGS

Embodiments of the present disclosure will be more clearly understood from the following detailed description taken in conjunction with the accompanying drawings in which:

FIG. 9A is a diagram illustrating a lookup table included in an LED driving apparatus, according to an embodiment of the present disclosure;

FIG. 9B is a diagram illustrating a lookup table included in an LED driving apparatus, according to an embodiment of the present disclosure;

DETAILED DESCRIPTION OF THE EMBODIMENTS

Figure 1:
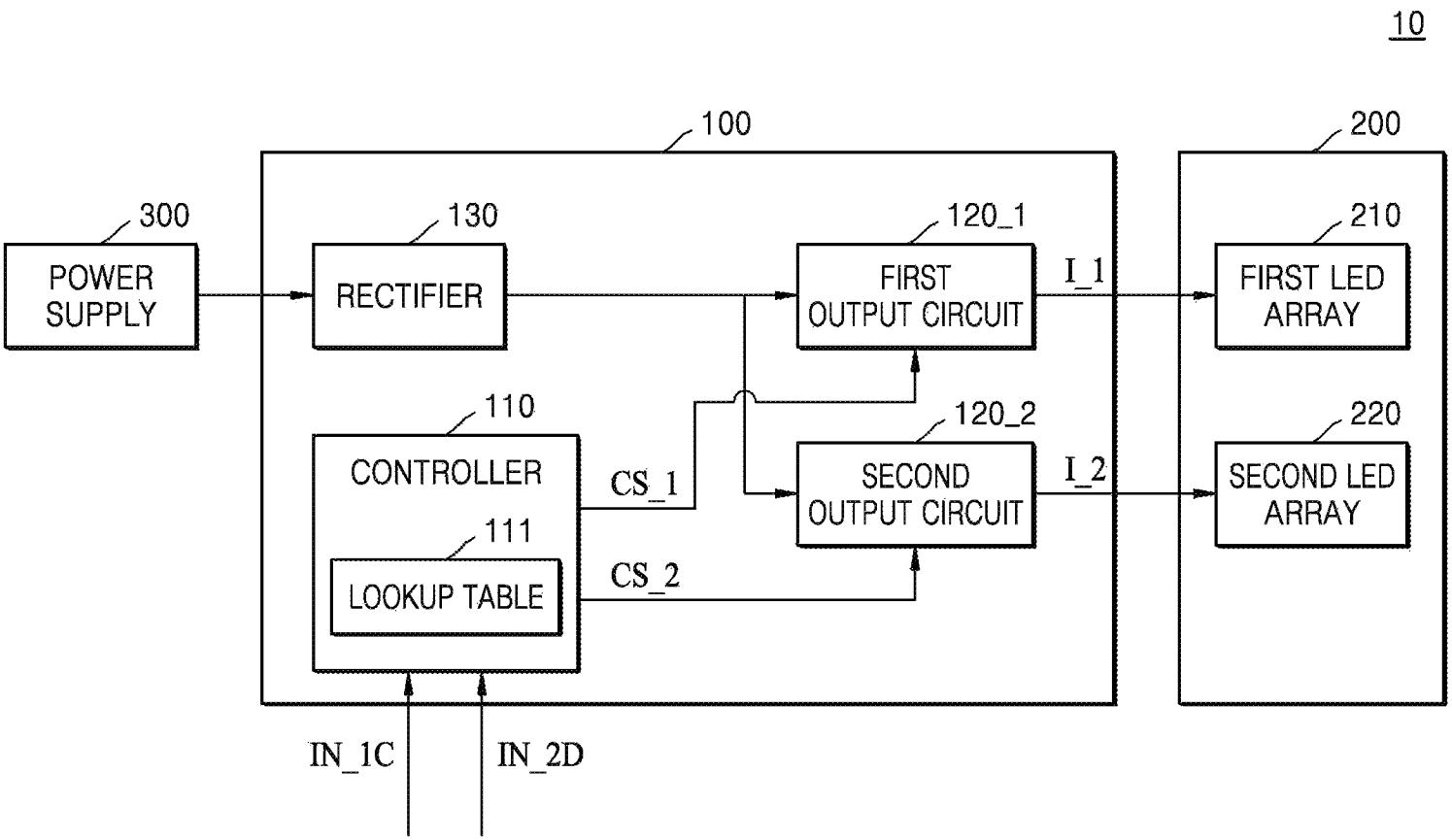
FIG. 1 is a block diagram of a lighting apparatus including a light-emitting diode (LED) driving apparatus, according to an embodiment of the present disclosure.

The present disclosure now will be described more fully hereinafter with reference to the accompanying drawings, in which various embodiments are shown. The invention may, however, be embodied in many different forms and should not be construed as limited to the example embodiments set forth herein. These example embodiments are just that—examples—and many implementations and variations are possible that do not require the details provided herein. It should also be emphasized that the disclosure provides details of alternative examples, but such listing of alternatives is not exhaustive. Furthermore, any consistency of detail between various examples should not be interpreted as requiring such detail—it is impracticable to list every possible variation for every feature described herein. The language of the claims should be referenced in determining the requirements of the invention.

It will be understood that, although the terms first, second, third etc. may be used herein to describe various elements, components, regions, layers and/or sections, these elements, components, regions, layers and/or sections should not be limited by these terms. Unless the context indicates otherwise, these terms are only used to distinguish one element, component, region, layer or section from another element, component, region, layer or section, for example as a naming convention. Thus, a first element, component, region, layer or section discussed below in one section of the specification could be termed a second element, component, region, layer or section in another section of the specification or in the claims without departing from the teachings of the present invention. In addition, in certain cases, even if a term is not described using "first," "second," etc., in the specification, it may still be referred to as "first" or "second" in a claim in order to distinguish different claimed elements from each other.

As is traditional in the field of the inventive concepts, embodiments are described, and illustrated in the drawings, in terms of functional blocks, units and/or modules. Those skilled in the art will appreciate that these blocks, units and/or modules are physically implemented by electronic (or optical) circuits such as logic circuits, discrete components, microprocessors, hard-wired circuits, memory elements, wiring connections, and the like, which may be formed using semiconductor-based fabrication techniques or other manufacturing technologies. In the case of the blocks, units and/or modules being implemented by microprocessors or similar, they may be programmed using software (e.g., microcode) to perform various functions discussed herein and may optionally be driven by firmware and/or software. Alternatively, each block, unit and/or module may be implemented by dedicated hardware, or as a combination of dedicated hardware to perform some functions and a processor (e.g., one or more programmed microprocessors and associated circuitry) to perform other functions. Also, each block, unit and/or module of the embodiments may be physically separated into two or more interacting and discrete blocks, units and/or modules without departing from the scope of the inventive concepts. Further, the blocks, units and/or modules of the embodiments may be physically combined into more complex blocks, units and/or modules without departing from the scope of the inventive concepts.

Figure 2:
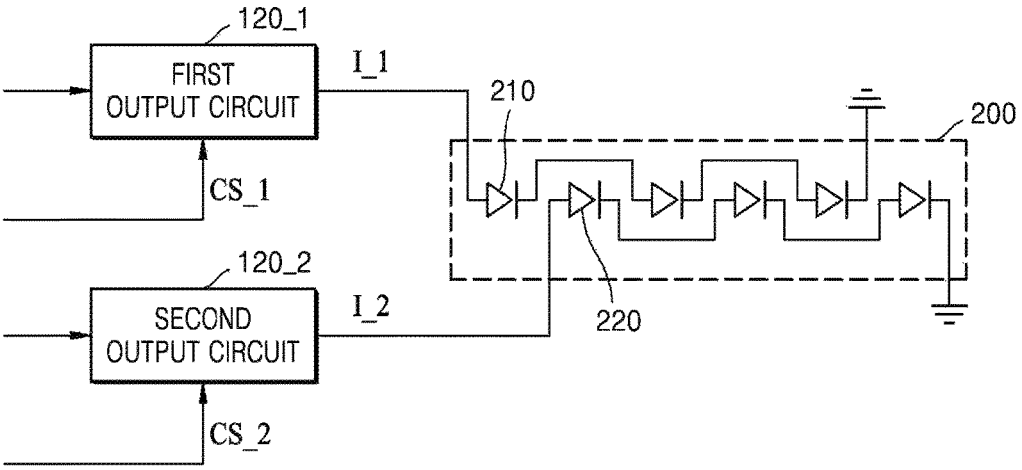
FIG. 2 is a simplified block diagram of a portion of a lighting apparatus according to an embodiment of the present disclosure.

FIG. 1 is a block diagram of a lighting apparatus 10 including a light-emitting diode (LED) driving apparatus 100, according to an embodiment of the present disclosure. FIG. 2 is a simplified block diagram of a portion of the lighting apparatus 10 according to an embodiment of the present disclosure.

Referring to FIG. 1, the lighting apparatus 10 may include the LED driving apparatus 100, an LED module 200, and a power supply 300, according to an embodiment of the present disclosure. The power supply 300 may output alternating current power. The LED module 200 is electrically connected to the power supply 300 via the LED driving apparatus 100. The power supply 300 according to some exemplary embodiments can include circuit components on a printed circuit board. For example, the power supply 300 may include circuit components configured to generate or convert power and supply the power to the LED module 200 via the LED driving apparatus 100. Alternatively, the power supply may be electrical wiring in a building, for example, connected to a power line, generator, transformer, battery, or other power source, or may refer to the generator, battery, transformer, etc.

The LED driving apparatus 100 may include a controller 110, a first output circuit 120_1, a second output circuit 120_2, and a rectifier 130. The controller 110 may be an integrated circuit (IC) chip outputting a first control signal CS_1 and a second control signal CS_2, which have certain frequencies and duty ratios (e.g., predetermined frequencies and duty ratios), to the first output circuit 120_1 and a second output circuit 120_2, respectively. The rectifier 130 may convert an alternating current outputted by the power supply 300 to a direct current.

The controller 110 may receive a first input signal IN_1C and a second input signal IN_2D from the outside of the LED driving apparatus 100. The controller 110 may include a lookup table 111, and the lookup table 111 may include information about the first control signal CS_1 and the second control signal CS_2 respectively corresponding to the first input signal IN_1C and the second input signal IN_2D. When the first input signal IN_1C and the second input signal IN_2D are received, the controller 110 may generate the first control signal CS_1 and the second control signal CS_2 based on the lookup table 111. Detailed descriptions on the lookup table 111 will be provided later with reference to FIGS. 5A and 6A.

When the first input signal IN_1C is received, the controller 110 may generate the first control signal CS_1 and the second control signal CS_2 based on the lookup table 111 so that color temperature of the LED module 200 may have a certain value (e.g., a predetermined value). In this exemplary embodiment, the color temperature of the LED module 200 may have a value in a range between a first color temperature of a first LED array 210 and a second color temperature of a second LED array 220.

In addition, when the second input signal IN_2D is received, the controller 110 may generate the first control signal CS_1 and the second control signal CS_2 based on the lookup table 111 so that the LED module 200 emits light having certain brightness (e.g., a predetermined brightness). A maximum value of brightness of the LED module 200 may be determined depending on the maximum brightness of the first LED array 210 and the maximum brightness of the second LED array 220.

The controller 110 may change the first control signal CS_1 and the second control signal CS_2 to correspond to the second input signal IN_2D, after having generated the first control signal CS_1 and the second control signal CS_2 corresponding to the first input signal IN_1C of the LED module 200. For example, the controller 110 may determine the brightness of the LED module 200 after the color temperature of the LED module 200 is determined.

The first output circuit 120_1 may receive the first control signal CS_1 from the controller 110. The first output circuit 120_1 may supply a first driving current I_1 to the first LED array 210 by using a direct current outputted by the rectifier 130. The first output circuit 120_1 may be controlled by the first control signal CS_1 and the first control signal CS_1 may control a magnitude of the first driving current I_1.

The second output circuit 120_2 may receive the second control signal CS_2 from the controller 110. The second output circuit 120_2 may supply a second driving current I_2 to the second LED array 220 by using the direct current outputted by the rectifier 130. The second output circuit 120_2 may be controlled by the second control signal CS_2 and the second control signal CS_2 may control a magnitude of the second driving current I_2.

Characteristics of the first driving current I_1 and the second driving current I_2 respectively outputted by the first output circuit 120_1 and the second output circuit 120_2 may be determined in accordance with operation frequency and the duty ratio of the first control signal CS_1 and operation frequency and the duty ratio of the second control signal CS_2. According to an embodiment, magnitude of the first driving current I_1 is proportionally related to the duty ratio of the first control signal CS_1 and magnitude of the second driving current I_2 is proportionally related to the duty ratio of the second control signal CS_2. For example, when the duty ratio of the first control signal CS_1 and the duty ratio of the second control signal CS_2 increase, magnitudes of the first driving current I_1 and the second driving current I_2 increase, respectively. When the duty ratio of the first control signal CS_1 and the duty ratio of the second control signal CS_2 decrease, magnitudes of the first driving current I_1 and the second driving current I_2 decrease, respectively.

In some embodiments, the first output circuit 120_1 and the second output circuit 120_2 may include DC-DC converter circuits having various topologies such as a fly-back converter, a buck converter, and a forward converter.

Referring to FIGS. 1 and 2, the LED module 200 may include the first LED array 210 and the second LED array 220. The first LED array 210 and the second LED array 220 may respectively include a plurality of LEDs, and the plurality of LEDs may be connected to each other in series or in parallel. For example, as illustrated in FIG. 2, a plurality of first LED elements included in the first LED array 210 and a plurality of second LED elements included in the second LED array 220 may be alternately arranged with each other.

For example, referring to FIG. 2, according to some exemplary embodiments, six LED elements are provided in the LED module 200. The first LED array 210 includes the first, third, and fifth LED elements connected in series with each other and the second LED array 220 includes the second, fourth, and sixth LED elements connected in series with each other. Unlike the illustration in FIG. 2, in some embodiments, the first LED array 210 may include the first, third, and fifth LED elements connected in parallel with each other and the second LED array 220 may include the second, fourth, and sixth LED elements connected in parallel with each other. Although not illustrated, in some embodiments, the second LED array 220 may include the first, third, and fifth LED elements connected in series or in parallel with each other and the first LED array 210 may include the second, fourth, and sixth LED elements connected in series or in parallel with each other. In FIG. 2, the LED module 200 includes six LED elements, although the scope of the present disclosure is not limited hereto. For example, in some embodiments, the LED module 200 may include less than six LED elements, and in some embodiments, the LED module 200 may include more than six LED elements and the first LED array 210 and the second LED array 220 may include any combination of LED elements connected in series or in parallel.

As shown in the various figures, an LED module or light source module may refer to a set of LED elements connected in a manner such that the module has an anode where anodes of one or more first LED elements of the LED module or the light source module receive power from a power supply and a cathode where cathodes of one or more last LEDs of the LED module or the light source module output a current that has passed through the LED elements of the LED module or the light source module.

The first LED array 210 and the second LED array 220 may have different color temperatures from each other. For example, the first LED array 210 may have the first color temperature and the second LED array 220 may have the second color temperature higher than the first color temperature. For example, the first LED array 210 may include a plurality of Warm White LEDs and the second LED array 220 may include a plurality of Cool White LEDs.

The color temperature of the LED module 200 including the first LED array 210 and the second LED array 220 may be changed in accordance with the first driving current I_1 and the second driving current I_2 respectively supplied to the first LED array 210 and the second LED array 220. For example, as the magnitude of the first driving current I_1 becomes greater than that of the second driving current I_2, the LED module 200 may have the color temperature closer to that of the Warm White by using the plurality of LEDs included in the first LED array 210. Alternatively, when the magnitude of the second driving current I_2 becomes greater than that of the first driving current I_1, the LED module 200 may have the color temperature closer to that of the Cool White by using the plurality of LEDs included in the second LED array 220.

In addition, the brightness of the LED module 200 may be changed in accordance with the first driving current I_1 and the second driving current I_2 respectively supplied to the first LED array 210 and the second LED array 220. According to an embodiment, magnitude of the first driving current I_1 is proportionally related to the brightness of the LED module 200 and magnitude of the second driving current I_2 is proportionally related to the brightness the LED module 200. For example, as magnitudes of the first driving current I_1 and the second driving current I_2 decrease, the brightness of the LED module 200 decreases, and as magnitudes of the first driving current I_1 and the second driving current I_2 increase, the brightness of the LED module 200 increases.

When a user applies the first input signal IN_1C to change the color temperature of the lighting apparatus 10 by using the lighting apparatus 10 from the outside of the lighting apparatus 10, the controller 110 may generate the first control signal CS_1 and the second control signal CS_2 corresponding to the first input signal IN_1C, based on the lookup table 111. The first output circuit 120_1 and the second output circuit 120_2 may respectively apply the first driving current I_1 and the second driving current I_2 to the LED module 200, based on the first control signal CS_1 and the second control signal CS_2, and the LED module 200 may emit light having the color temperature as desired by the user. Accordingly, the LED driving apparatus 100 and the lighting apparatus 10 may change the color temperature of the LED module 200 by applying the first input signal IN_1C, for example, only one signal to the LED driving apparatus 100 and the lighting apparatus 10, while maintaining the brightness of the LED module 200, according to the present disclosure. The LED driving apparatus 100 and the lighting apparatus 10 according to the present disclosure may be easily used in an environment wherein various color temperatures are required.

In addition, when the user applies the second input signal IN_2D to change the brightness of the lighting apparatus 10 by using the lighting apparatus 10 from the outside of the lighting apparatus 10, the controller 110 may generate the first control signal CS_1 and the second control signal CS_2 corresponding to the second input signal IN_2D, based on the lookup table 111. The first output circuit 120_1 and the second output circuit 120_2 may respectively apply the first driving current I_1 and the second driving current I_2 to the LED module 200, based on the first control signal CS_1 and the second control signal CS_2, and the LED module 200 may emit light having brightness as desired by the user. Accordingly, the LED driving apparatus 100 and the lighting apparatus 10 may change the brightness of the LED module 200 by applying the second input signal IN_2D, for example, only one signal to the LED driving apparatus 100 and the lighting apparatus 10, while maintaining the color temperature of the LED module 200, according to the present disclosure.

Figure 3:
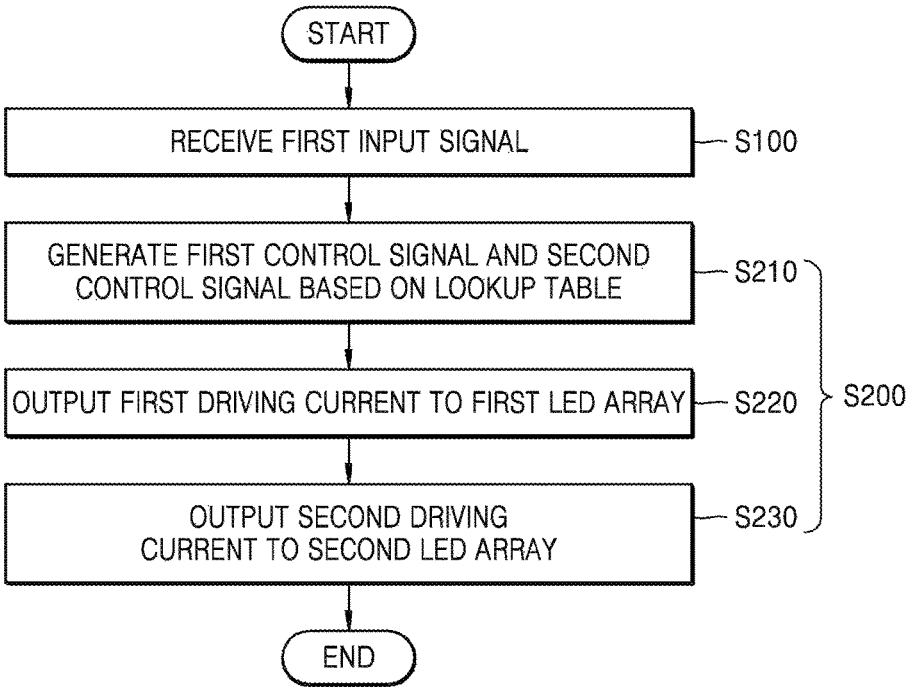
FIG. 3 is a flowchart of a method of driving the LED for controlling color temperature of an LED module, according to an embodiment of the present disclosure.

FIG. 3 is a flowchart of a method of driving an LED for controlling the color temperature of the LED module 200, according to an embodiment of the present disclosure.

Referring to FIGS. 1 and 3, the LED driving apparatus 100 may receive the first input signal IN_1C from the outside of the LED driving apparatus 100 (S100). The first input signal IN_1C may be a voltage applied to the LED driving apparatus 100 by the user for controlling the color temperature of the lighting apparatus 10. In some embodiments, the first input signal IN_1C may be a current supplied to the LED driving apparatus 100 by the user for controlling the color temperature of the lighting apparatus 10. The LED driving apparatus 100 may control the color temperature of the LED module 200 between the first color temperature of the first LED array 210 and the second color temperature of the second LED array 220, based on the first input signal IN_1C (S200).

In order to control the color temperature of the LED module 200 (S200), the controller 110 may generate the first control signal CS_1 and the second control signal CS_2 corresponding to the first input signal IN_1C, based on the lookup table 111, after the first input signal IN_1C is received (S210). Information about the first control signal CS_1 and the second control signal CS_2 corresponding to the first input signal IN_1C may be included so that the LED module 200 may emit light having a certain color temperature (e.g., a predetermined color temperature).

The first output circuit 120_1 may output to the first LED array 210 the first driving current I_1 controlled by the first control signal CS_1 (S220). The first LED array 210 may emit light having certain brightness (explained further below) in accordance with the first driving current I_1.

The second output circuit 120_2 may output to the second LED array 220 the second driving current I_2 controlled by the second control signal CS_2 (S230). The second LED array 220 may emit light having certain brightness (explained further below) in accordance with the second driving current I_2.

The LED module 200 may control the color temperature in accordance with a ratio of brightness of the first LED array 210 over brightness of the second LED array 220. Accordingly, the color temperature of the LED module 200 may be controlled in accordance with characteristics of the first control signal CS_1 and the second control signal CS_2. By using this controllability, the controller 110 may control the color temperature of the LED module 200 by generating the first control signal CS_1 and the second control signal CS_2 corresponding to the first input signal IN_1C (S200). According to the present disclosure, since the user can control the color temperature of the LED module 200 by using the LED driving apparatus 100 and controlling the magnitude of the first input signal IN_1C, controlling the color temperature of the lighting apparatus 10 may be easier compared to conventional lighting apparatuses.

Figures 4, 5A:
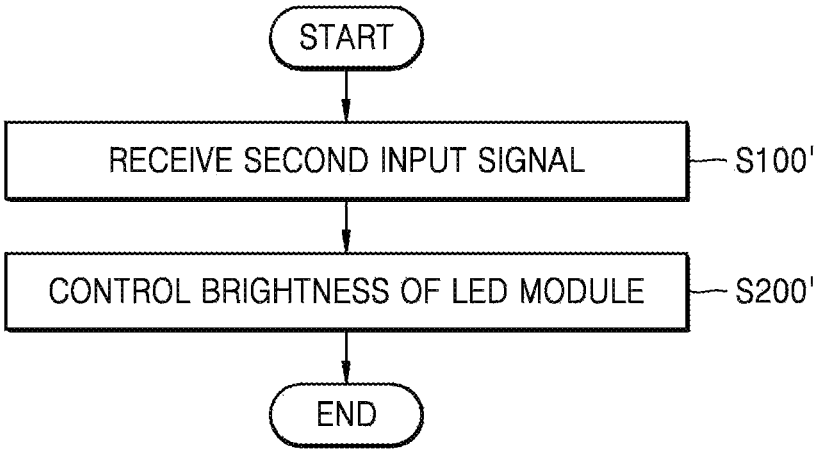
FIG. 4 is a flowchart of a method of driving the LED for controlling brightness of an LED module, according to an embodiment of the present disclosure.
FIG. 5A is a diagram illustrating a lookup table included in an LED driving apparatus, according to an embodiment of the present disclosure.

FIG. 4 is a flowchart of a method of driving an LED for controlling brightness of the LED module 200, according to an embodiment of the present disclosure.

Referring to FIGS. 1 and 4, the LED driving apparatus 100 may receive the second input signal IN_2D from the outside (S100') of the LED driving apparatus 100. The second input signal IN_2D may be a voltage applied to the LED driving apparatus 100 for controlling the brightness of the lighting apparatus 10 by the user. In some embodiments, the second input signal IN_2D may be a current supplied to the LED driving apparatus 100 by the user for controlling the color brightness of the lighting apparatus 10. The LED driving apparatus 100 may control the brightness of the LED module 200 based on the second input signal IN_2D (S200').

In order to control the brightness of the LED module 200 (S200') the controller 110 may generate the first control signal CS_1 and the second control signal CS_2 corresponding to the second input signal IN_2D after the second input signal IN_2D is received. The lookup table 111 may include information about the first control signal CS_1 and the second control signal CS_2 corresponding to the second input signal IN_2D so that the LED module 200 may emit light having certain brightness.

The brightness of the LED module 200 including the first LED array 210 and the second LED array 220 may be controlled in accordance with the brightness of the first LED array 210 and the brightness of the second LED array 220. Accordingly, the controller 110 may control the brightness of the LED module 200 by generating the first control signal CS_1 and the second control signal CS_2 corresponding to the second input signal IN_2D (S200'). Thus, when the LED driving apparatus 100 according to the present disclosure is used, the user may control the magnitude of the first input signal IN_1C for controlling the color temperature of the LED module 200 and simultaneously controlling the brightness of the LED module 200 by controlling the magnitude of the second input signal IN_2D. In addition, it is possible that the user may independently control the color temperature and the brightness of the LED module 200. For example, when the LED driving apparatus 100 receives only the first input signal IN_1C, the color temperature of the LED module 200 may be changed to a desired level by controlling the magnitude of the first input signal IN_1C and simultaneously maintaining the brightness of the LED module 200 and when the LED driving apparatus 100 receives only the second input signal IN_2D, the brightness of the LED module 200 may be changed to a desired level by controlling the magnitude of the second input signal IN_2D and simultaneously maintaining the color temperature of the LED module 200.

Figure 5B:
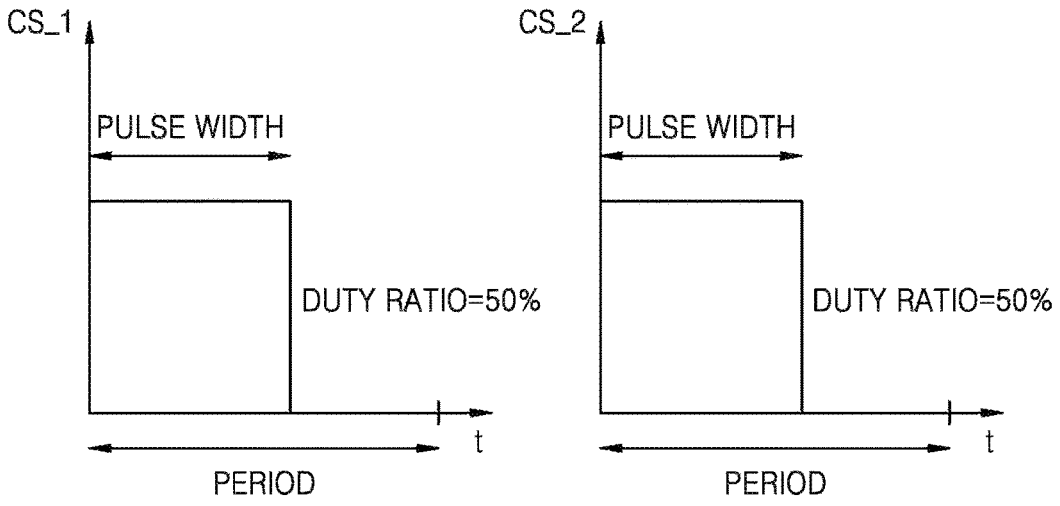
FIG. 5B illustrates wave diagrams illustrating changes in a first control signal and a second control signal outputted by a controller.
Figure 5C:
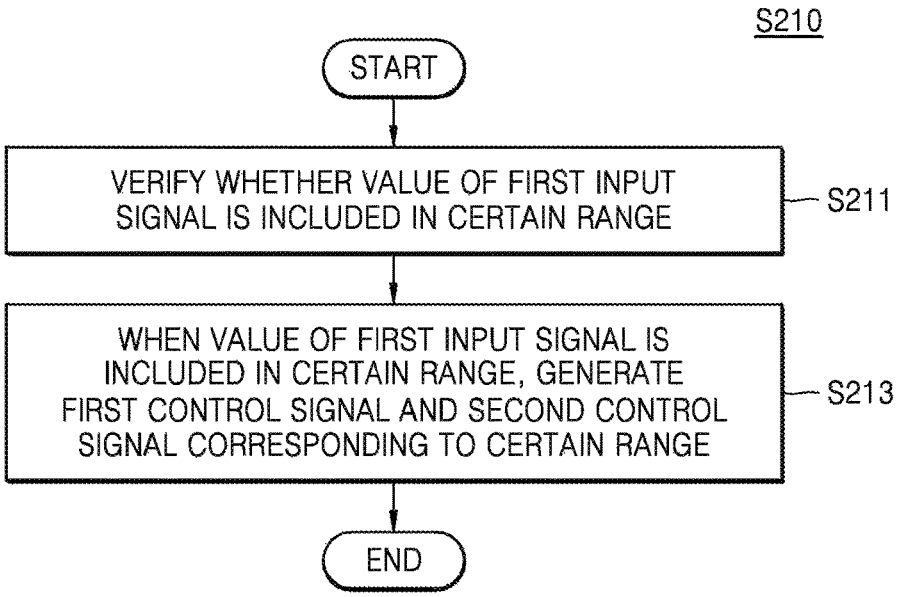
FIG. 5C is a flowchart of an operation of generating the first control signal and the second control signal of FIG. 3 (S210)

FIG. 5A is a diagram illustrating a lookup table 111_1 included in the LED driving apparatus 100, according to an embodiment of the present disclosure. FIG. 5B illustrates wave diagrams illustrating changes in the first control signal CS_1 and the second control signal CS_2 outputted by the controller 110 in the case when the duty ratio of the first control signal CS_1 and the duty ratio of the second control signal CS_2 are about 50%. For example, in terms of a square wave signal as illustrated in FIG. 5B, the duty ratio of 50% of the first control signal CS_1 defines that the percentage of time for which the first control signal CS_1 is at logic high level is about the same as the percentage of time for which the first control signal CS_1 is at logic low level. Similarly, in terms of square wave signal as illustrated in FIG. 5B, the duty ratio of 50% of the second control signal CS_2 defines that the percentage of time for which the second control signal CS_2 is at logic high level is about the same as the percentage of time for which the second control signal CS_2 is at logic low level. However, the disclosure is not limited thereto. In some embodiments, the duty ratio of the first control signal CS_1 and the duty ratio of the second control signal CS_2 may be less than 50% or more than 50% depending on desired color temperature of the LED module 200, e.g., as illustrated in the first lookup table 111_1 of FIG. 5A. FIG. 5C is a flowchart of an operation (S210) of generating the first control signal CS_1 and the second control signal CS_2 of FIG. 3.

Referring to FIGS. 1 and 5A, the LED module 200 may include the first LED array 210 and the second LED array 220. For example, the first LED array 210 may have a color temperature of about 2700K and the second LED array 220 may have a color temperature of about 6500K. The color temperature of about 2700K may be a preset industry standard color temperature value for the first LED array 210 (may also be referred to as a default color temperature value for the first LED array 210) and the color temperature of about 6500K may be a preset industry standard color temperature value for the second LED array 220 (may also be referred to as a default color temperature value for the second LED array 220). Thus, the LED driving apparatus 100 may control the LED module 200 so that the color temperature of the LED module 200 is between about 2700K and about 6500K.

The lookup table 111 may include the first lookup table 111_1 including information about the first control signal CS_1 and the second control signal CS_2 corresponding to the first input signal IN_1C. The first lookup table 111_1 may include information about the first control signal CS_1 and the second control signal CS_2 which are different from each other with respect to a range of the first input signal IN_1C. The first control signal CS_1 and the second control signal CS_2 may be pulse width modulated (PWM) signals having controllable pulse widths.

According to an embodiment, as illustrated in FIG. 5A, information about the first control signal CS_1 and the second control signal CS_2 may mean the duty ratio of the first control signal CS_1 and the duty ratio of the second control signal CS_2. For example, when the brightness of the LED module 200 is about 100%, this information may mean the duty ratio of the first control signal CS_1 and the duty ratio of the second control signal CS_2 which have different color temperatures from each other.

In FIG. 5A, the first lookup table 111_1 is illustrated to include the color temperature of the LED module 200 in accordance with the first control signal CS_1 and the second control signal CS_2. However, the embodiment is not limited thereto and the first lookup table 111_1 may not separately store the color temperatures.

For example, when the first input signal IN_1C has a value between a value equal to or greater than about 0 V and a value less than about 2 V, the duty ratio of the first control signal CS_1 and the duty ratio of the second control signal CS_2 corresponding to the first input signal IN_1C may be respectively stored as about 100% and about 0% in the first lookup table 111_1. Thus, when the first input signal IN_1C of about 1 V is received by the LED driving apparatus 100, the color temperature of the LED module 200 may be controlled at about 2700K.

As another example, when the first input signal IN_1C is equal to or greater than about 5 V and less than about 6 V, the duty ratio of the first control signal CS_1 and the duty ratio of the second control signal CS_2 corresponding to the first input signal IN_1C may be respectively stored as about 50% and about 50% in the first lookup table 111_1. Thus, when the first input signal IN_1C of about 5 V is received by the LED driving apparatus 100, the color temperature of the LED module 200 may be controlled at about 4000K. As illustrated in FIG. 5B, when the first input signal IN_1C is about 5 V, the first control signal CS_1 and the second control signal CS_2 may be generated so that duty ratios of high-level pulse widths in one cycle are about 50%.

Alternatively, when the first input signal IN_1C has a value equal to or greater than about 8 V and equal to or less than about 10 V, the duty ratio of the first control signal CS_1 and the duty ratio of the second control signal CS_2 corresponding to the first input signal IN_1C may be respectively stored as about 0% and about 100% in the first lookup table 111_1. Thus, when the first input signal IN_1C of about 9 V is received by the LED driving apparatus 100, the color temperature of the LED module 200 may be controlled at about 6500K.

In the exemplary embodiments, when the color temperature of the LED module 200 is controlled at about 2700K, about 4000K, and about 6500K are described. However, as illustrated in FIG. 5A, the color temperature of the LED module 200 may have values between about 2700K and about 4000K, or between about 4000K and about 6500K, and to this end, information about the first control signal CS_1 and the second control signal CS_2 corresponding to the first input signal IN_1C may be included in the first lookup table 111_1.

The first lookup table 111_1 may be configured so that the color temperature of the LED module 200 increases as the value of the first input signal IN_1C increases. Thus, the LED driving apparatus 100 may provide to the LED module 200 the first driving current I_1 and the second driving current I_2 so that the color temperature of the LED module 200 increases as the value of the first input signal IN_1C increases.

However, the first lookup table 111_1 illustrated in FIG. 5A is only exemplary for describing an embodiment of the present disclosure, and the embodiment is not limited thereto. The range of the first input signal IN_1C and the duty ratio of the first control signal CS_1 and the duty ratio of the second control signal CS_2 corresponding to the range of the first input signal IN_1C may be determined depending on the color temperature the user wants to use. In addition, the first lookup table 111_1 may be configured so that the color temperature of the LED module 200 increase as the value of the first input signal IN_1C decreases.

The duty ratio of the first control signal CS_1 and the duty ratio of the second control signal CS_2 may vary and are to be provided respectively to the first output circuit 120_1 and the second output circuit 120_2 for enabling the LED module 200 to have a certain color temperature (e.g., a predetermined color temperature), depending on the color temperature and the maximum brightness of the first LED array 210 included in the LED module 200, the color temperature and the maximum brightness of the second LED array 220, and an internal configuration of the LED driving apparatus 100.

According to another exemplary embodiment, information about the first control signal CS_1 and the second control signal CS_2 to be stored in the first lookup table 111_1 may mean a ratio of the duty ratio of the second control signal CS_2 over the duty ratio of the first control signal CS_1. Accordingly, the duty ratio of the first control signal CS_1 and the duty ratio of the second control signal CS_2 may not be respectively stored in the first lookup table 111_1 as illustrated in FIG. 5A, but only a ratio value of the duty ratio of the second control signal CS_2 over the duty ratio of the first control signal CS_1 may be stored.

Referring to FIGS. 1 and 5C, the controller 110 may verify whether the first input signal IN_1C is included in a certain range (e.g., a predetermined range) (S211) for generating the first control signal CS_1 and the second control signal CS_2 corresponding to the first input signal IN_1C (S210). For example, the certain range may be one of ranges of the first input signal IN_1C stored in the first lookup table 111_1 of FIG. 5A.

When the first input signal IN_1C is in the certain range, the controller 110 may generate the first control signal CS_1 and the second control signal CS_2 corresponding to the certain range (e.g., one of ranges of the first input signal IN_1C stored in the first lookup table 111_1 of FIG. 5A) of the first input signal IN_1C (S213), and transmit the first control signal CS_1 and the second control signal CS_2 respectively to the first output circuit 120_1 and the second output circuit 120_2.

Figures 6A, 6B:
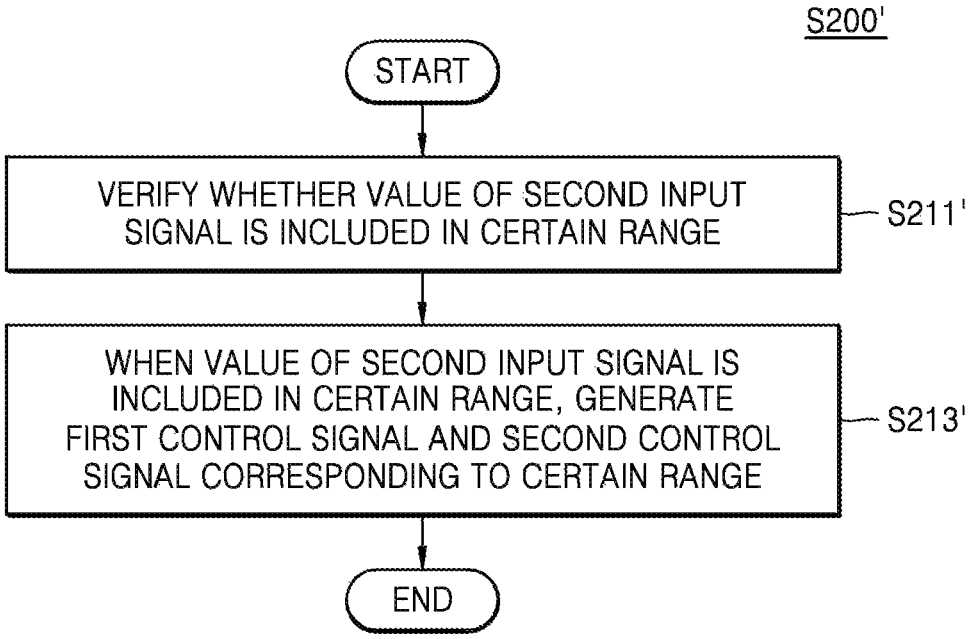
FIG. 6A is a diagram illustrating a lookup table included in an LED driving apparatus, according to an embodiment of the present disclosure.
FIG. 6B is a flowchart of an operation of controlling the brightness of the LED module in FIG. 4 (S200')

FIG. 6A is a diagram illustrating a lookup table 111_2 included in the LED driving apparatus 100, according to an embodiment of the present disclosure. FIG. 6B is a flowchart of an operation of controlling the brightness of the LED module 200 in FIG. 4 (S200').

Referring to FIGS. 1 and 6A, the lookup table 111 may include the second lookup table 111_2 including information about the first control signal CS_1 and the second control signal CS_2 corresponding to the second input signal IN_2D. The second lookup table 111_2 may include information about the first control signal CS_1 and the second control signal CS_2 which are different from each other with respect to a range of the second input signal IN_2D. The controller 110 may generate the first control signal CS_1 and the second control signal CS_2 based on the second lookup table 111_2.

For example, when the second lookup table 111_2 illustrated in FIG. 6A is included in the controller 110, and the second input signal IN_2D received by the controller 110 has a value between a value equal to or greater than about 0 V and a value less than 2 V, the controller 110 may generate the first control signal CS_1 and the second control signal CS_2 so that the brightness of the LED module 200 is about 0% (i.e., the lowest brightness). In addition, when the second input signal IN_2D is between equal to or greater than 4 V or less than 5 V, the controller 110 may generate the first control signal CS_1 and the second control signal CS_2 so that the brightness of the LED module 200 is about 40%, and when the second input signal IN_2D is equal to or greater than 8 V or less than about 10 V, the controller 110 may generate the first control signal CS_1 and the second control signal CS_2 so that the brightness of the LED module 200 is about 100% (i.e., the highest brightness).

Exemplary embodiments have been described when each LED module 200 is controlled to have respective brightness of about 0%, about 40%, and about 100%. However, as illustrated in FIG. 6A, the second lookup table 111_2 may include information about the first control signal CS_1 and the second control signal CS_2 corresponding to the second input signal IN_2D so that the brightness of the LED module 200 is controlled to have a value between about 0% and about 40%, or a value between about 40% and about 100%.

The second lookup table 111_2 may be configured so that the brightness of the LED module 200 increases as the value of the second input signal IN_2D increases. Thus, the LED driving apparatus 100 may provide the first driving current I_1 and the second driving current I_2 to the LED module 200 so that the brightness of the LED module 200 increases as the value of the second input signal IN_2D increases.

However, the second lookup table 111_2 illustrated in FIG. 6A is only exemplary for describing an embodiment of the present disclosure. The range of the second input signal IN_2D and information about the first control signal CS_1 and the second control signal CS_2 corresponding to the range of the second input signal IN_2D may be determined depending on the brightness the user wants to use. In addition, the second lookup table 111_2 may be configured so that the brightness of the LED module 200 increases as the value of the second input signal IN_2D decreases.

Referring to FIGS. 1 and 6B, the controller 110 may verify, for controlling the brightness (S200'), whether the second input signal IN_2D is in the certain range of the second lookup table (S211'). For example, the certain range may be one of ranges of the second input signal IN_2D stored in the second lookup table 111_2 of FIG. 6A.

When the second input signal IN_2D is included in the certain range, the controller 110 may generate the first control signal CS_1 and the second control signal CS_2 corresponding to the certain range (e.g., one of ranges of the second input signal IN_2D stored in the second lookup table 111_2 of FIG. 6A) of the second input signal IN_2D (S213'), and transmit the first control signal CS_1 and the second control signal CS_2 respectively to the first output circuit 120_1 and the second output circuit 120_2.

Referring to FIGS. 1, 5C, and 6B, the LED driving apparatus 100 may simultaneously receive the first input signal IN_1C and the second input signal IN_2D. The first lookup table 111_1 of FIG. 5A and the second lookup table 111_2 of FIG. 6A will be used as examples. When the controller 110 receives the first input signal IN_1C of about 5V and the second input signal IN_2D of about 10 V, for controlling the color temperature of the LED module 200 at about 4000K, the controller 110 may respectively control the duty ratio of the first control signal CS_1 and the duty ratio of the second control signal CS_2 at about 50%, based on the first lookup table 111_1. Since the first lookup table 111_1 of FIG. 5A is stored based on brightness of about 100% (e.g., the maximum brightness), the first control signal CS_1 and the second control signal CS_2 may be respectively transmitted to the first output circuit 120_1 and the second output circuit 120_2 while respective duty ratios thereof are maintained at about 50%. Thus, the LED module 200 may emit light having a color temperature of about 4000K and brightness of about 100%.

As another example, the controller 110 may receive the first input signal IN_1C of about 5 V and the second input signal IN_2D of about 4 V. For controlling the color temperature of the LED module 200 at about 4000K, the controller 110 may control respective duty ratios of the first control signal CS_1 and the second control signal CS_2 at about 50%, based on the first lookup table 111_1 of FIG. 5A. Next, for controlling the brightness of the LED module 200 at about 40%, the controller 110 may decrease respective duty ratios of the first control signal CS_1 and the second control signal CS_2 from about 50% by a certain rate, based on the second lookup table 111_2 of FIG. 6A. In this exemplary embodiment, since the color temperature of the LED module 200 needs to be constantly maintained at about 4000K, the controller 110 may constantly maintain the rate of duty ratio of the first control signal CS_1 over the duty ratio of the second control signal CS_2.

When the first control signal CS_1 and the second control signal CS_2 having been adjusted based on the second lookup table 111_2 are transmitted to the first output circuit 120_1 and the second output circuit 120_2, the first driving current I_1 and the second driving current I_2 controlled respectively by the first control signal CS_1 and the second control signal CS_2 are provided to the LED module 200, the LED module 200 may emit light having the color temperature of about 4000K and brightness of about 40%.

For example, when the first input signal IN_1C and the second input signal IN_2D are simultaneously received, the controller 110 may determine the duty ratio of the first control signal CS_1 and the duty ratio of the second control signal CS_2 based on the first lookup table 111_1, and thereafter, readjust the duty ratio of the first control signal CS_1 and the duty ratio of the second control signal CS_2 based on the second lookup table 111_2.

Figure 7A:
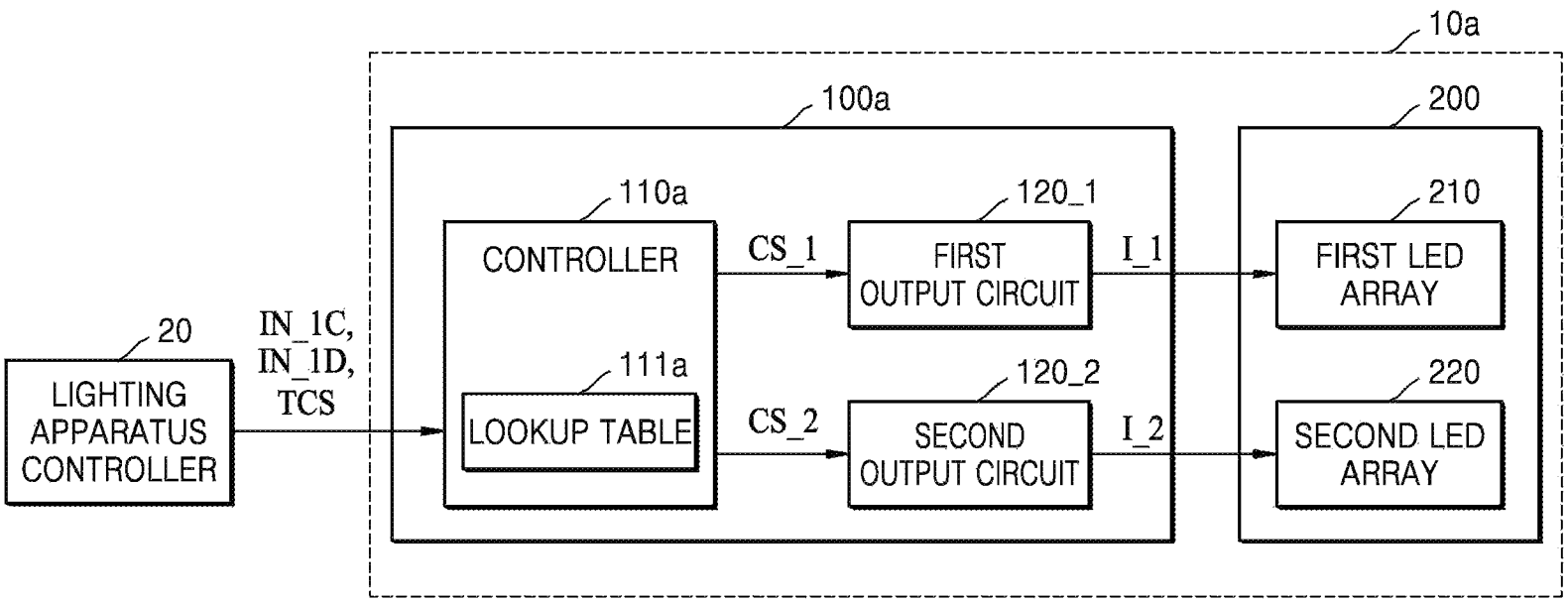
FIG. 7A is a block diagram of a lighting apparatus including an LED driving apparatus, according to an embodiment of the present disclosure.
Figure 7B:
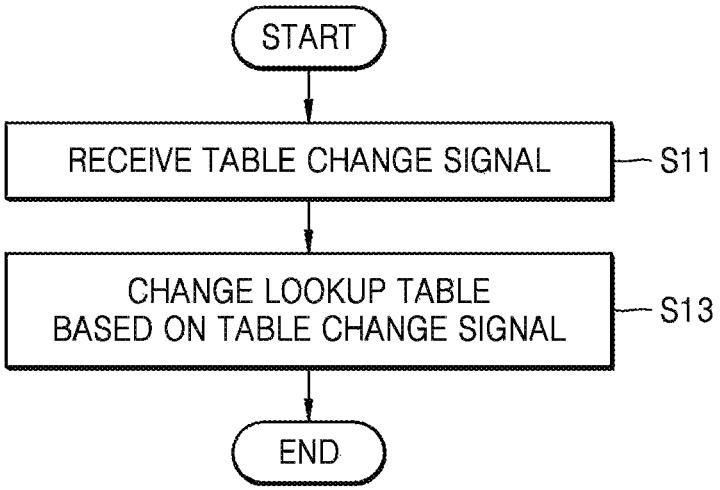
FIG. 7B is a flowchart of a method of driving the LED for changing a lookup table, according to an embodiment of the present disclosure.

FIG. 7A is a block diagram of a lighting apparatus 10*a* including an LED driving apparatus 100*a*, according to an embodiment of the present disclosure. FIG. 7B is a flowchart of a method of driving an LED for changing a lookup table 111*a*, according to an embodiment of the present disclosure.

Referring to FIG. 7A, the lighting apparatus 10*a* may include the LED driving apparatus 100*a* and the LED module 200. The LED driving apparatus 100*a* may include a controller 110*a*, a first output circuit 120_1, and a second output circuit 120_2.

The LED module 200 may include the first LED array 210 and the second LED array 220. The first LED array 210 may have the first color temperature and the second LED array 220 may have the second color temperature higher than the first color temperature.

The controller 110*a* may receive the first input signal IN_1C, the second input signal IN_2D, and a table change signal (TCS) from a lighting apparatus controller 20 which is outside the controller 110*a*. When the TCS is received, the controller 110*a* may change a lookup table stored therein based on the TCS. The lookup table 111*a* illustrated in FIG. 7A may be the lookup table after the change.

The controller 110*a* may include the lookup table 111*a* and the lookup table 111*a* may include information about the first control signal CS_1 and the second control signal CS_2 corresponding to the first input signal IN_1C and the second input signal IN_2D. When the first input signal IN_1C and the second input signal IN_2D are received, the controller 110*a* may generate the first control signal CS_1 and the second control signal CS_2 based on the lookup table 111*a*.

Referring to FIGS. 7A and 7B, for changing the lookup table 111*a* stored in the LED driving apparatus 100*a*, the lighting apparatus controller 20 may generate the TCS, and the controller 110*a* may receive the TCS from the lighting apparatus controller 20 (S11). The TCS may include information about the lookup table 111*a* after the change. The controller 110*a* may change the lookup table 111*a* based on the TCS (S13). According to an embodiment of the present disclosure, the LED driving apparatus 100*a* and the lighting apparatus 10*a* may change the lookup table 111*a* as needed, and thus, may be used in various environments.

According to an embodiment, when the TCS is received, the controller 110*a* may delete information about the first control signal CS_1 and the second control signal CS_2 corresponding to a portion of the first input signal IN_1C or the second input signal IN_2D which is not used by the user in the lookup table 111*a*, and store the lookup table 111*a* which is new. Descriptions on this issue will be provided later with reference to FIG. 9A.

According to another embodiment, when the TCS is received, the controller 110*a* may select a range of the color temperature of the LED module 200 to be used by the user in a range between the first color temperature and the second color temperature. The controller 110*a* may store a new lookup table 111*a* which includes information about the first control signal CS_1 and the second control signal CS_2 corresponding to the first input signal IN_1C, based on the selected range of the color temperature. Details on this issue will be provided later with reference to FIG. 9A.

Figure 8:
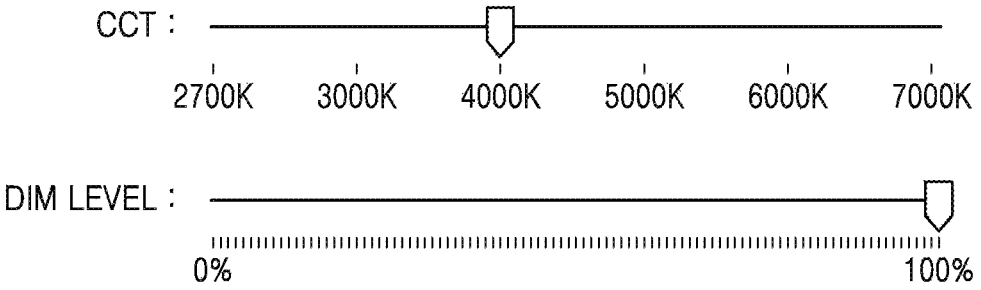
FIG. 8 is a diagram illustrating a display unit of a lighting apparatus controller.

FIG. 8 is a diagram illustrating a display unit of the lighting apparatus controller 20.

Referring to FIGS. 7A and 8, the lighting apparatus controller 20 and the controller 110*a* may be connected for communication via particular communication interfaces such as RS485, USB, Bluetooth, I2C, and Ethernet. For example, the lighting apparatus controller 20 may be implemented by a personal computer (PC) and a mobile device such as a smart phone, a tablet, and a laptop computer.

The lighting apparatus controller 20 may include the display unit and an input unit. The display unit may output information processed by the lighting apparatus controller 20 in a user-identifiable form such as visual information. For example, the display unit may display a user interface (UI).

The input unit may generate key input data that the user enters for controlling operations of the lighting apparatus controller 20. The input unit may include a key pad, a dome switch, a touch pad, a jog wheel, a jog switch, or a finger mouse. Particularly, when the touch pad forms a mutual layer structure with a pad display unit, a touch screen may be formed. When the display unit and the input unit form the touch screen, the display unit may function as the input unit.

The user may input, via the input unit, a desired color temperature and a brightness value of the lighting apparatus 10*a*, and the display unit may output an input result in a user-identifiable form such as visual information. FIG. 8 illustrates an exemplary embodiment when the user has inputted the color temperature of about 4000K and brightness of about 100%. When the lighting apparatus 10*a* includes the first lookup table 111_1 of FIG. 5A and the second lookup table 111_2 of FIG. 6A, the lighting apparatus controller 20 may separately transmit the first input signal IN_1C of about 5 V and the second input signal IN_2D of about 10 V to the lighting apparatus 10*a* via the communication interfaces.

FIGS. 9A and 9B are diagrams illustrating lookup tables 111-1*a* and 111-1*a*' included in an LED driving apparatus, according to an embodiment of the present disclosure.

Referring to FIGS. 7A and 9A, the LED module 200 may include the first LED array 210 and the second LED array 220. For example, the first LED array 210 may have the color temperature of about 2700K and the second LED array 220 may have the color temperature of about 6500K. Thus, the LED driving apparatus 100*a* may control the LED module 200 to have a color temperature between about 2700K and about 6500K.

The lookup table 111*a* may include the first lookup table 111_1*a* including information about the first control signal CS_1 and the second control signal CS_2 corresponding to the first input signal IN_1C. The first lookup table 111_1*a* may have been changed from the first lookup table 111_1 of FIG. 5.

When a portion of the plurality of color temperatures available in the lighting apparatus 10 is not used, the TCS is output to the lighting apparatus 10 by controlling the lighting apparatus controller 20 via the input unit of the lighting apparatus controller 20.

For example, when the first lookup table 111_1 of FIG. 5A is referred to, the user may use light having color temperatures of about 2700K, about 3000K, about 3500K, about 4000K, about 5000K, and about 6500K, by using the lighting apparatus 10. Since light having color temperatures of about 3000K and about 4000K is not needed, the TCS may be transmitted to the lighting apparatus 10 via the lighting apparatus controller 20.

The controller 110*a* may change the duty ratio of the first control signal CS_1 and the duty ratio of the second control signal CS_2 to about 0% by deleting, from the first lookup table 111_1 of FIG. 5A, information about the first control signal CS_1 and the second control signal CS_2 corresponding to the first input signal IN_1C having a voltage of equal to or greater than about 2 V and less than about 4 V, and equal to or greater than about 5 V and less than about 6V.

FIG. 9A illustrates only the first lookup table 111_1*a* including information about the first control signal CS_1 and the second control signal CS_2 corresponding to the first input signal IN_1C. However, the embodiment is not limited thereto. When the user does not use a portion of a plurality of brightnesses available in the lighting apparatus 10, the TCS may be transmitted to the lighting apparatus 10 by controlling the lighting apparatus controller 20 via the input unit of the lighting apparatus controller 20, and change a second lookup table including information about the first control signal CS_1 and the second control signal CS_2 corresponding to the second input signal IN_2D based on the TCS.

Referring to FIGS. 7A and 9B, the lookup table 111*a* may include the first lookup table 111_1*a*' including information about the first control signal CS_1 and the second control signal CS_2 corresponding to the first input signal IN_1C. The first lookup table 111_1*a*' may have been changed from the first lookup table 111_1 of FIG. 5A.

When a portion of a plurality of color temperatures available in the lighting apparatus 10 is not used, the TCS may be transmitted to the lighting apparatus 10 by controlling the lighting apparatus controller 20 via the input unit of the lighting apparatus controller 20.

For example, when the first lookup table 111_1 of FIG. 5A is referred to, the user may utilize light having the color temperatures of about 2700K, about 3000K, about 3500K, about 4000K, about 5000K, and about 6500K, by using the lighting apparatus 10. Since light having the color temperatures of about 3000K and about 4000K is not needed, the TCS may be transmitted to the lighting apparatus 10 via the lighting apparatus controller 20.

The controller 110*a* may change information about the first control signal CS_1 and the second control signal CS_2 corresponding to the first input signal IN_1C equal to or greater than about 2 V and less than about 4 V, in the first lookup table 111_1 of FIG. 5A. For example, the duty ratio of the first control signal CS_1 and the duty ratio of the second control signal CS_2 corresponding to the first input signal IN_1C equal to or greater than about 2 V and less than about 3 V may be changed from about 70% and about 30% to about 100% and about 0%, respectively. In addition, the duty ratio of the first control signal CS_1 and the duty ratio of the second control signal CS_2 corresponding to the first input signal IN_1C equal to or greater than about 3 V and less than about 4 V may be changed from about 70% and about 30% to about 60% and about 40%. In a similar manner, the controller 110*a* may change information about the first control signal CS_1 and the second control signal CS_2 corresponding to the first input signal IN_1C of equal to or greater than about 5 V and less than about 6 V, in the first lookup table 111_1 of FIG. 5A.

FIG. 9B illustrates only the first lookup table 111_1*a*' including information about the first control signal CS_1 and the second control signal CS_2 corresponding to the first input signal IN_1C. However, the embodiment is not limited thereto. When a portion of the plurality of brightnesses available in the lighting apparatus 10 is not used, the TCS may be transmitted to the lighting apparatus 10 by controlling the lighting apparatus controller 20 via the input unit of the lighting apparatus controller 20. The controller may change the second lookup table including information about the first control signal CS_1 and the second control signal CS_2 corresponding to the second input signal IN_2D, based on the TCS.

In addition, FIG. 9B illustrates the first lookup table 111_1*a*' which has been changed, when a portion of color temperatures among the plurality of color temperatures available to the user is not needed. However, the embodiment is not limited thereto. Even when other color temperatures except the plurality of color temperatures available to the user are needed, that is, when other color temperatures except about 2700K, about 3000K, about 3500K, about 4000K, about 5000K, and about 6500K in FIG. 9B are needed, the TCS may be transmitted to the lighting apparatus 10 by controlling the lighting apparatus controller 20 via the input unit of the lighting apparatus controller 20. The controller 110*a* may store the first lookup table so that the LED module 200 can emit light having new color temperatures, by changing the duty ratio of the first control signal CS_1 and the duty ratio of the second control signal CS_2, based on the TCS.

Figure 10A:
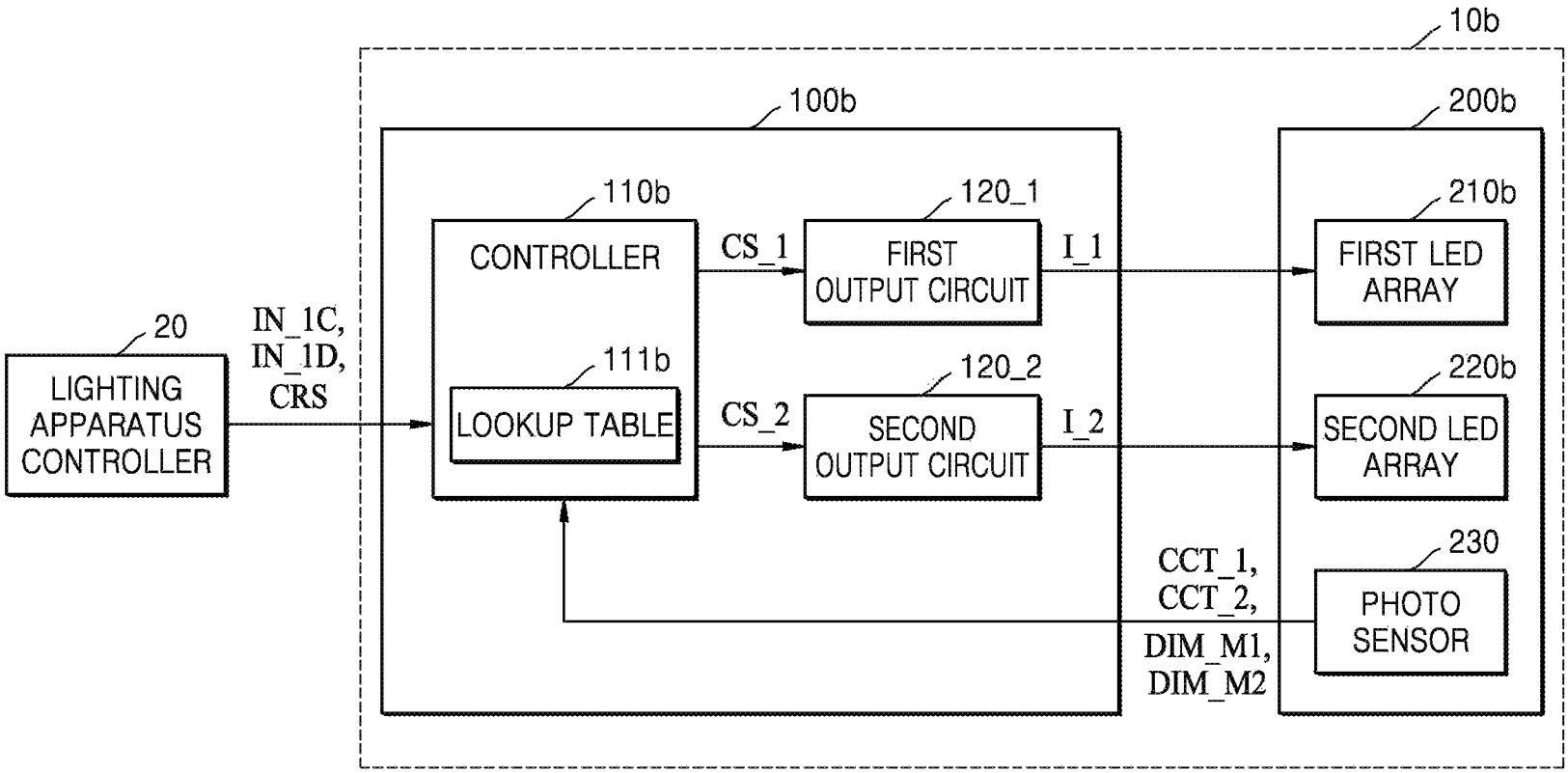
FIG. 10A is a block diagram of a lighting apparatus including an LED driving apparatus, according to an embodiment of the present disclosure.
Figure 10B:
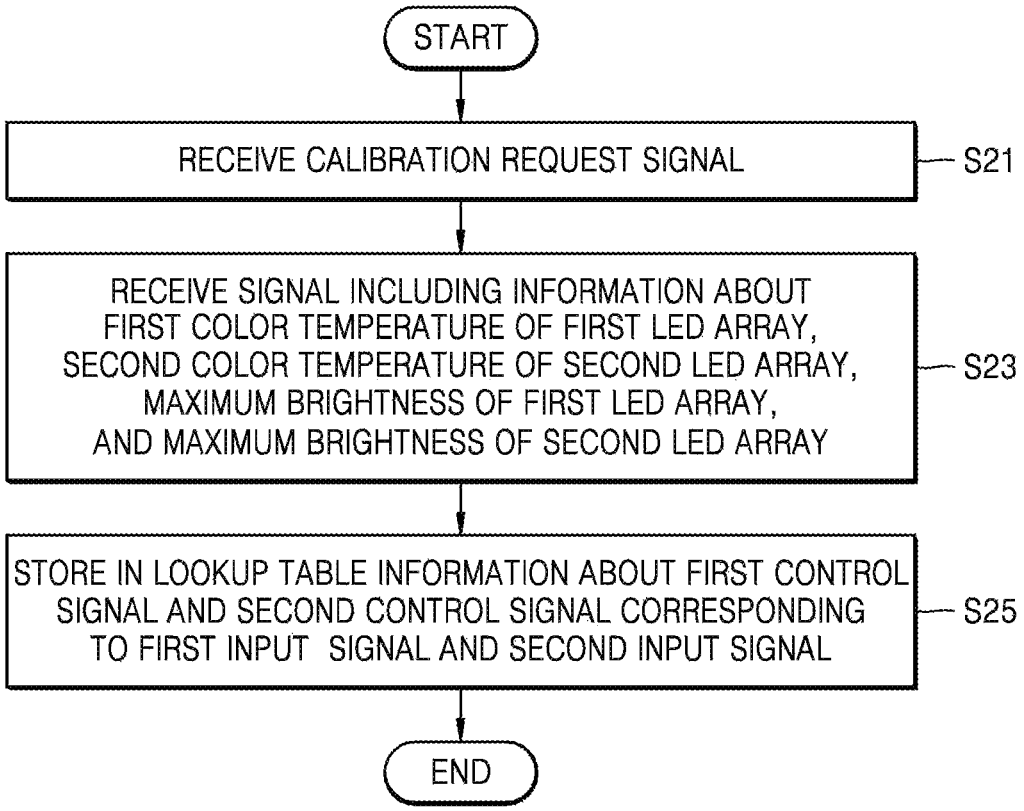
FIG. 10B is a flowchart of a method of driving the LED, according to an embodiment of the present disclosure.

FIG. 10A is a block diagram of a lighting apparatus 10*b* including an LED driving apparatus 100*b*, according to an embodiment of the present disclosure. FIG. 10B is a flowchart of a method of driving an LED, according to an embodiment of the present disclosure. FIGS. 10A and 10B describe embodiments when an existing LED module connected to an LED driving apparatus has been replaced with a new LED module, or color temperatures and maximum brightness of a plurality of LED arrays included in an LED module have been changed.

Referring to FIG. 10A, an LED module 200*b* may include a first LED array 210*b*, a second LED array 220*b*, and a photo sensor 230. The first LED array 210*b* may have the first color temperature and the second LED array 220*b* may have the second color temperature higher than the first color temperature. For example, the first LED array 210*b* may include a plurality of Warm White LEDs and the second LED array 220*b* may include a plurality of Cool White LEDs.

The photo sensor 230 may measure the first color temperature and brightness of the first LED array 210*b*, and the second color temperature and brightness of the second LED array 220*b*. The photo sensor 230 may transmit to a controller 110*b* signals (CCT_1, CCT_2, DIM_M1, and DIM_M2) including information about the first color temperature, the second color temperature, a maximum brightness of the first LED array 210*b* and a maximum brightness of the second LED array 220*b*, which have been measured. In this exemplary embodiment, the signal CCT_1 includes information about the first color temperature, the signal CCT_2 includes information about the second color temperature, the signal DIM_M1 includes information about a maximum brightness of the first LED array 210*b* and the signal DIM_M2 includes information about a maximum brightness of the second LED array 220*b*.

When the existing LED module connected to the LED driving apparatus 100*b* is replaced with a new LED module 200*b*, or when at least one of the first color temperature and the maximum brightness of the first LED array 210*b* connected to the LED driving apparatus 100*b* and the second temperature and the maximum brightness of the second LED array 220*b* are changed from an existing value, the lighting apparatus controller 20 may generate a calibration request signal (CRS). However, the embodiment is not limited thereto. Even when characteristics of the first LED array and the second LED array included in the existing LED module connected to the LED driving apparatus 100*b*, for example, the color temperature and brightness are changed, the lighting apparatus controller 20 may generate the CRS and the LED driving apparatus 100*b* may execute a calibration operation.

The controller 110*b* may receive the first input signal IN_1C, the second input signal IN_2D, and the CRS from the lighting apparatus controller 20 which is outside the controller 110*b*. When the controller 110*b* receives the CRS, the calibration operation for changing the lookup table may be executed. The controller 110*b* may receive the signals (CCT_1, CCT_2, DIM_M1, and DIM_M2) including information about the first color temperature, the second color temperature, the maximum brightness of the first LED array 210*b*, and the maximum brightness of the second LED array 220*b*, and change an existing lookup table which has been already stored. The lookup table 111*b* in FIG. 10A may mean the lookup table after the change.

When the first input signal IN_1C and the second input signal IN_2D are received, the controller 110*b* may generate the first control signal CS_1 and the second control signal CS_2, based on the lookup table 111*b*.

Referring to FIGS. 10A and 10B, when the new LED module 200*b* is connected to the LED driving apparatus 100*b*, the lighting apparatus controller 20 may generate the CRS and the controller 110*b* may receive the CRS from the lighting apparatus controller 20 (S21). Accordingly, the controller 110*b* may receive, for changing an already stored lookup table, the signals (CCT_1, CCT_2, DIM_M1, and DIM_M2) including information about the first color temperature, the second color temperature, the maximum brightness of the first LED array 210*b*, and the maximum brightness of the second LED array 220*b* from the outside photo sensor 230 (S23).

In FIG. 10A, the photo sensor 230 is illustrated as being included in the LED module 200*b*. However, the embodiment is not limited thereto. The LED module 200*b* may not include the photo sensor 230, and the controller 110*b* may receive the signals (CCT_1, CCT_2, DIM_M1, and DIM_M2) including information about the first color temperature, the second color temperature, the maximum brightness of the first LED array 210*b*, and the maximum brightness of the second LED array 220*b* from the photo sensor 230 outside the LED module 200*b*.

The controller 110*b* may store in the lookup table 111*b* information about the first control signal CS_1 and the second control signal CS_2 corresponding to the first input signal IN_1C and the second input signal IN_2D, based on information about the first color temperature, the second color temperature, the maximum brightness of the first LED array 210*b*, and the maximum brightness of the second LED array 220*b* (S25).

According to an embodiment, the controller 110*b* may select at least one third color temperature having a value between the first color temperature and the second color temperature, and store in the lookup table 111*b* a first range, a second range, and a third range of the first input signal IN_1C respectively corresponding to the first color temperature, the second color temperature, and the at least one third color temperature. Detailed description on this issue will be provided later with reference to FIG. 11.

Since the lookup table 111*b* can be reset even when characteristics of the LED module 200*b* connected to the LED driving apparatus 100*b* are changed, the LED driving apparatus 100*b* and the lighting apparatus 10*b* according to an embodiment of the present disclosure may be used in various environments.

Figures 11, 12:
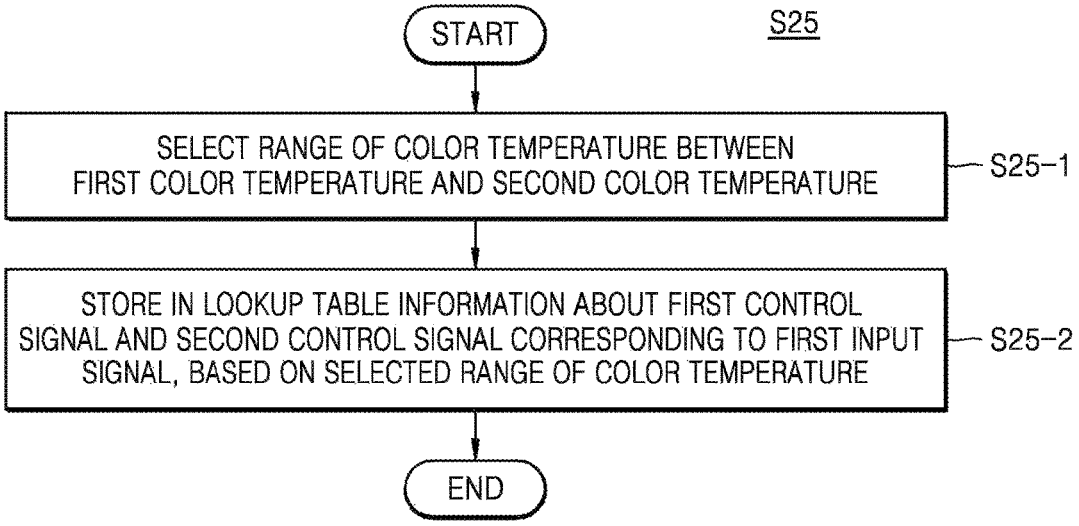
FIG. 11 is a diagram illustrating a lookup table included in an LED driving apparatus, according to an embodiment of the present disclosure.
FIG. 12 is a flowchart of a method of driving the LED, according to an embodiment of the present disclosure.

FIG. 11 is a diagram illustrating a lookup table 111_1*b* included in an LED driving apparatus, according to an embodiment of the present disclosure. FIG. 11 is a drawing for describing a method of storing the lookup table 111_1*b* of FIG. 10*b* (S25).

Referring to FIGS. 10A and 11, the LED module 200*b* may include the first LED array 210*b* and the second LED array 220*b*. For example, the first LED array 210*b* may have a color temperature of about 3000K and the second LED array 220*b* may have a color temperature of about 5000K. The maximum brightness of the first LED array 210*b* and the maximum brightness of the second LED array 220*b* may be the same.

The lookup table 111*b* included in the controller 110*b* may include the first lookup table 111_1*b* including information about the first control signal CS_1 and the second control signal CS_2 corresponding to the first input signal IN_1C. The first lookup table 111_1*b* may include information about the first control signal CS_1 and the second control signal CS_2, which are different from each other with respect to the range of the first input signal IN_1C.

The controller 110*b* may store in the first lookup table 111_1*b* information about the first control signal CS_1 and the second control signal CS_2 corresponding to the first input signal IN_1C, based on information about the first color temperature of the first LED array 210*b*, the second color temperature of the second LED array 220*b*, the maximum brightness of the first LED array 210*b*, and the maximum brightness of the second LED array 220*b*, which are transmitted from the photo sensor 230. Since the first color temperature has a value of about 3000K and the second color temperature has a value of about 5000K, the controller 110*b* may build the first lookup table 111_1*b* in a range between about 3000K and about 5000K.

For example, the controller 110*b* may select color temperatures having values of about 3500K and about 4000K, which are between about 3000K and about 5000K. The ranges of the first input signal IN_1C respectively corresponding to about 3000K, about 3500K, about 4000K, and about 5000K may be determined as equal to or greater than 0 V and less than 2 V, equal to or greater than 2 V and less than about 5 V, equal to or greater than 5V and less than 7 V, and equal to or greater than 7 V and less than 10 V. The controller 110*b* may store in the lookup table 111*b* information about the first control signal CS_1 and the second control signal CS_2 which control the first output circuit 120_1 and the second output circuit 120_2 so that the controller 110*b* can emit light having color temperatures of about 3000K, about 3500K, about 4000K, and about 5000K. The information about the first control signal CS_1 and the second control signal CS_2 may be the duty ratio of the first control signal CS_1 and the duty ratio of the second control signal CS_2, respectively.

For example, when the first input signal IN_1C has a value equal to or greater than 0 V and less than 2 V, the duty ratio of the first control signal CS_1 and the duty ratio of the second control signal CS_2 corresponding to the first input signal IN_1C may be respectively stored as about 100% and about 0% in the first lookup table 111_1*b*. Thus, when the first input signal IN_1C of about 1 V is received by the LED driving apparatus 100*b*, the color temperature of the LED module 200*b* may be controlled at about 3000K.

As another example, when the first input signal IN_1C has a value equal to or greater than 5 V and less than about 7 V, the duty ratio of the first control signal CS_1 and the duty ratio of the second control signal CS_2 corresponding to the first input signal IN_1C may be respectively stored as about 50% and about 50% in the first lookup table 111_1*b*. Thus, when the first input signal IN_1C of about 5 V is received by the LED driving apparatus 100*b*, the color temperature of the LED module 200*b* may be controlled at about 4000K.

Alternatively, when the first input signal IN_1C has a value equal to or greater than 7 V and less than about 10 V, the duty ratio of the first control signal CS_1 and the duty ratio of the second control signal CS_2 corresponding to the first input signal IN_1C may be respectively stored as about 0% and about 100% in the first lookup table 111_1*b*. Thus, when the first input signal IN_1C of about 9 V is received by the LED driving apparatus 100*b*, the color temperature of the LED module 200*b* may be controlled at about 5000K.

The first lookup table 111_1*b* may be configured so that the color temperature of the LED module 200*b* increases as the value of the first input signal IN_1C increases. The controller 110*b* may generate the first control signal CS_1 and the second control signal CS_2 based on the first lookup table 111_1*b* so that the color temperature of the LED module 200*b* increases as the value of the first input signal IN_1C increases. Thus, when the user wants to increase the color temperature of the lighting apparatus 10*b*, the color temperature of the lighting apparatus 10*b* may be increased by increasing the value of the first input signal IN_1C applied to the LED driving apparatus 100*b*.

However, the first lookup table 111_1*b* illustrated in FIG. 11 is only exemplary, and the duty ratio of the first control signal CS_1 and the duty ratio of the second control signal CS_2 corresponding to the range of the first input signal IN_1C and the range of the second input signal IN_2D may be established with respect to the color temperatures the user wants to use. In addition, the first lookup table 111_1*b* may be configured so that the color temperature of the LED module 200*b* increases as the value of the first input signal IN_1C decreases.

The duty ratio of the first control signal CS_1 and the duty ratio of the second control signal CS_2, which need to be provided to the first output circuit 120_1 and the second output circuit 120_2 so that the LED module 200*b* has a certain color temperature, may vary depending on the color temperature and the maximum brightness of the first LED array 210*b*, the color temperature and the maximum brightness of the second LED array 220*b*, which are included in the LED module 200*b*, and an internal configuration of the LED driving apparatus 100*b*.

In FIG. 11, the color temperature of the LED module 200*b* in accordance with the first control signal CS_1 and the second control signal CS_2 is illustrated to be included in the first lookup table 111_1*b*. However, the embodiment is not limited thereto, and the color temperature may not be separately stored in the first lookup table 111_1*b*.

The lookup table 111*b* included in the controller 110*b* may include the second lookup table including information about the first control signal CS_1 and the second control signal CS_2 corresponding to the second input signal IN_2D. The second lookup table may include information about the first control signal CS_1 and the second control signal CS_2 that is different from each other depending on the range of the second input signal IN_2D. The controller 110*b* may store in the second lookup table information about the first control signal CS_1 and the second control signal CS_2 corresponding to the second input signal IN_2D, based on information about the maximum brightness of the first LED array 210*b* and the maximum brightness of the second LED array 220*b* transmitted from the photo sensor 230, and the LED driving apparatus 100*b* may control the brightness of the LED module 200*b* based on the second lookup table FIG. 12 is a flowchart of a method of driving an LED, according to an embodiment of the present disclosure. FIG. 12 is a flowchart of an operation of storing the lookup table 111*b* of FIG. 10B (S25).

Referring to FIGS. 10A and 12, the controller 110*b* may receive the CRS from the lighting apparatus controller 20, and receive from the outside photo sensor 230 the signals (CCT_1, CCT_2, DIM_M1, and DIM_M2) including the first color temperature of the first LED array 210*b*, the second color temperature of the second LED array 220*b*, the maximum brightness of the first LED array 210*b*, and the maximum brightness of the second LED array 220*b*.

The controller 110*b* may select a range of the color temperature to be used by the LED module 200*b* from the range between the first color temperature and the second color temperature (S25-1). The range of the color temperature to be used may be selected based on information stored in the LED driving apparatus 100*b*. According to an embodiment, the range of the color temperature may be selected based on a lookup table before the calibration operation is executed. According to another embodiment, when a portion of the range between the first color temperature and the second color temperature is not used, the user may control the lighting apparatus controller 20 via the input unit of the lighting apparatus controller 20 and output the TCS to the LED driving apparatus 100*b*, as illustrated in FIG. 7A. The controller 110*b* may select the range of the color temperature to be used based on the TCS.

The controller 110*b* may store in the lookup table 111*b* information about the first control signal CS_1 and the second control signal CS_2 corresponding to the first input signal IN_1C, based on the range of the color temperature to be used (S25-2).

For example, when the first LED array 210*b* has the color temperature of about 3000K and the second LED array 220*b* has the color temperature of about 5000K, the lighting apparatus 10*b* may emit light having the color temperature between about 3000K and about 5000K. When the user does not need light having a color temperature between about 3000K and about 3500K and output the TCS to the LED driving apparatus 100*b*, the controller 110*b* may select the range of the color temperature to be used by the LED module 200*b* between about 3500K and about 5000K. The controller 110*b* may store in the lookup table 111*b* information about the first control signal CS_1 and the second control signal CS_2 corresponding to the first input signal IN_1C, based on the range of the color temperature of between about 3500K and about 5000K.

FIG. 12 illustrates an exemplary embodiment when the range of the color temperature is selected. However, even when the user does not use a portion of the plurality of brightness available to the lighting apparatus 10*b*, the controller 110*a* may select a range of brightness to be used by the user and store in the lookup table 111*b* information about the first control signal CS_1 and the second control signal CS_2 corresponding to the first input signal IN_2D.

Figure 13:
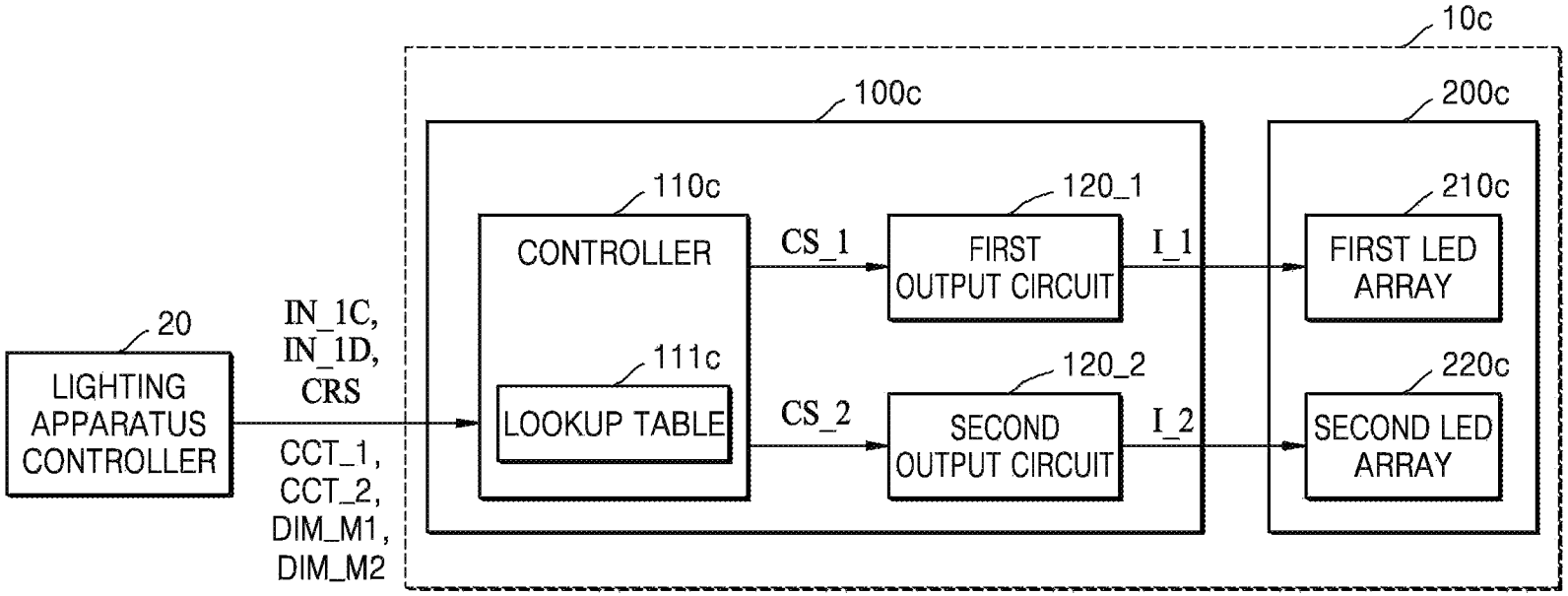
FIG. 13 is a block diagram of a lighting apparatus including an LED driving apparatus, according to an embodiment of the present disclosure.

FIG. 13 is a block diagram of a lighting apparatus 10*c* including an LED driving apparatus 100*c*, according to an embodiment of the present disclosure. FIG. 13 describes exemplary embodiments when an existing LED module connected to an LED driving apparatus has been replaced with a new LED module or color temperatures and maximum brightness of a plurality of LED arrays included in an LED module have been changed.

Referring to FIG. 13, when a first color temperature and a maximum brightness of a first LED array 210*c* and a second color temperature and a maximum brightness of a second LED array 220*c*, which are connected to the LED driving apparatus 100*c*, are changed from current values, the lighting apparatus controller 20 may generate the CRS. The lighting apparatus controller 20 may transmit to the controller 110*c* the signals (CCT_1, CCT_2, DIM_M1, and DIM_M2) including the first color temperature, the second color temperature, the maximum brightness of the first LED array 210*c*, and the maximum brightness of the second LED array 220*c* along with the CRS. In this exemplary embodiment, the signal CCT_1 includes information about the first color temperature, the signal CCT_2 includes information about the second color temperature, the signal DIM_M1 includes information about the maximum brightness of the first LED array 210*c* and the signal DIM_M2 includes information about the maximum brightness of the second LED array 220*c*.

When the CRS is received from the lighting apparatus controller 20, the controller 110*c* may execute the calibration operation for changing the lookup table 111*c*. The controller 110*c* may store in the lookup table 111*c* information about the first control signal CS_1 and the second control signal CS_2 corresponding to the first input signal IN_1C and the second input signal IN_2D, based on the first color temperature, the second color temperature, the maximum brightness of the first LED array 210*c*, and the maximum brightness of the second LED array 220*c*.

According to an embodiment, the controller 110*c* may select at least one third color temperature having a value between the first color temperature and the second color temperature, and store in the lookup table 111*c* information about the first range, the second range, and the third range respectively corresponding to the first color temperature, the second color temperature, and the at least one third color temperature.

The calibration operation of the controller 110*c* may be similarly executed as the calibration operation of the controller 110*b* described with reference to FIGS. 10A, 10B, 11, and 13.

When the first input signal IN_1C and the second input signal IN_2D are received, the controller 110*c* may generate the first control signal CS_1 and the second control signal CS_2 based on the lookup table 111*c*.

In some embodiments, a method of driving an LED module including a first LED array having a first color temperature and a second LED array having a second color temperature different from the first color temperature may include: storing, into a lookup table included in an LED driving apparatus, information about a first control signal corresponding to a first input signal and information about a second control signal corresponding to a second input signal; receiving the first input signal. The method may also include generating the first control signal and the second control signal based on the lookup table; and controlling the LED module based on the first input signal so that color temperature of the LED module has a value between the first color temperature of the first LED array and the second color temperature of the second LED array while maintaining brightness of the LED module.

In some embodiments, the method of driving the LED module may further include: receiving the second input signal; and controlling brightness of the LED module based on the second input signal.

Figure 14:
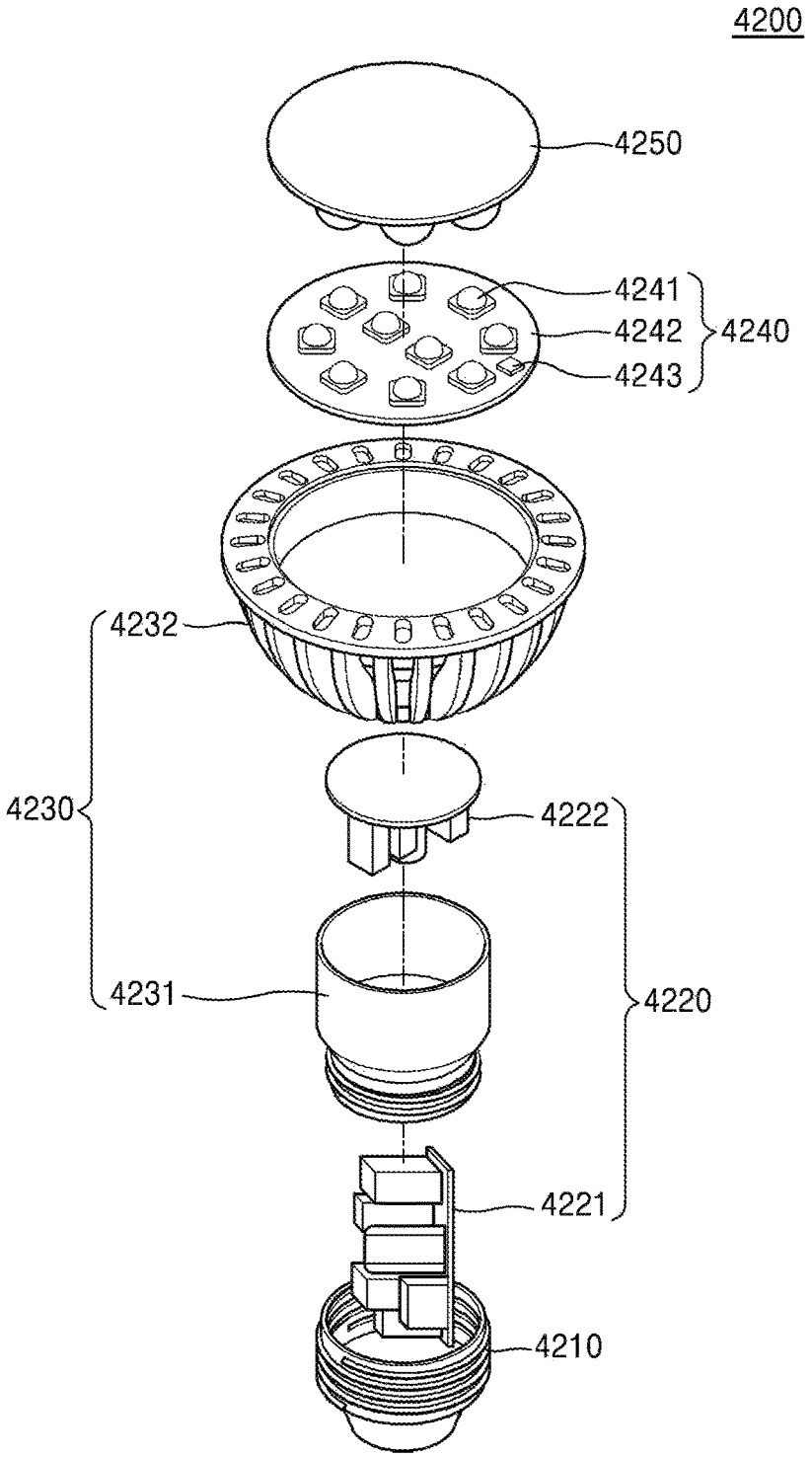
FIG. 14 is an exploded perspective view of a bulb-type lamp as a lighting apparatus, according to an embodiment of the present disclosure.

FIG. 14 is an exploded perspective view of a bulb-type lamp as a lighting apparatus 4200, according to an embodiment of the present disclosure.

The lighting apparatus 4200 may include a socket 4210, a power supply 4220, a heat radiator 4230, a light source module 4240, and an optical unit 4250. According to an embodiment of the present disclosure, the light source module 4240 may include an LED array and the power supply 4220 may include an LED driving unit. The light source module 4240 may be the LED modules (200, 200*b*, or 200*c*) in FIGS. 1, 10A, and 13, and the LED driving unit may include the LED driving apparatus (100, 100*a*, 100*b*, or 100*c*) in FIGS. 1, 7A, 10A, and 13.

The socket 4210 may be configured to be replaceable with an existing lighting apparatus. Power supplied to the lighting apparatus 4200 may be applied via the socket 4210. As illustrated in FIG. 14, the power supply 4220 may include a first power supply 4221 and a second power supply 4222, which are separable. The heat radiator 4230 may include an internal heat radiator 4231 and an external heat radiator 4232, and the internal heat radiator 4231 may be directly connected to the light source module 4240 and/or the power supply 4220, and in this manner, heat may be transferred to the external heat radiator 4232. The optical unit 4250 may include an internal optical unit (not shown) and an external optical unit (not shown), and be configured to distribute evenly light emitted by the light source module 4240.

The light source module 4240 may receive power from the power supply 4220 and emit light to the optical unit 4250. The light source module 4240 may include at least one LED 4241, a circuit substrate 4242, and a controller 4243, and the controller 4243 may store information about driving LEDs 4241.

Figure 15:
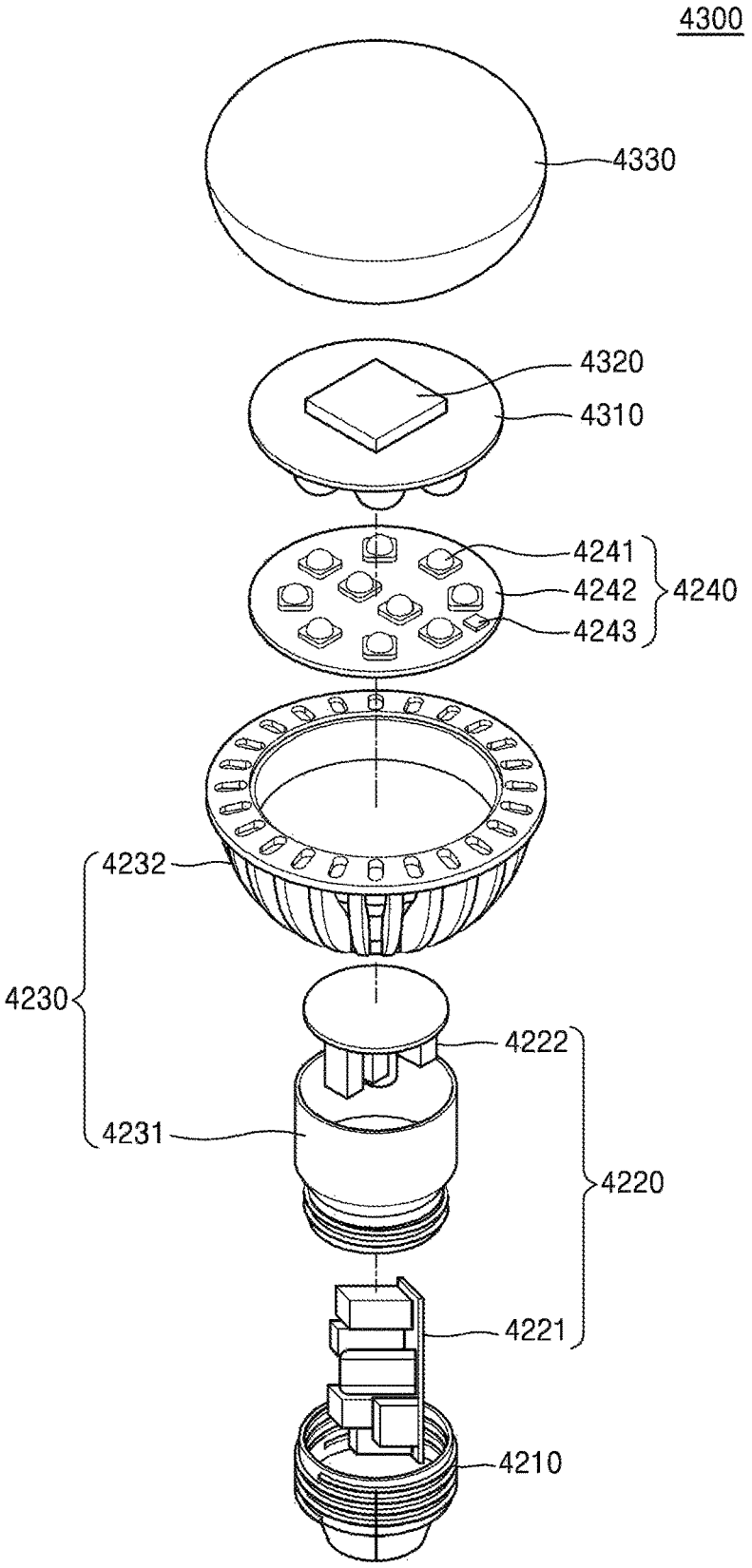
FIG. 15 is an exploded perspective view of a lamp including a communication module, as a lighting apparatus, according to an embodiment of the present disclosure.

FIG. 15 is an exploded perspective view of a lamp including a communication module, as a lighting apparatus 4300, according to an embodiment of the present disclosure.

According to an embodiment, the lighting apparatus 4300 is different from the lighting apparatus 4200 of FIG. 15 in that a reflecting plate 4310 is included on the light source module 4240. The reflecting plate 4310 may reduce glaring by evenly spreading light from light sources to the side and back thereof.

A communication module 4320 may be on the reflecting plate 4310 and a home-network communication may be implemented via the communication module 4320. For example, the communication module 4320 may be a wireless communication module using Zigbee, WiFi, or LiFi, and control lighting operations such as on/off and brightness control installed inside and outside a home via a smart phone or a wireless controller. In addition, a LiFi communication may control electronic devices and vehicle systems such as a TV, a refrigerator, an air-conditioner, a door-lock, and a car, which are installed inside and outside the home, by using visible ray wavelengths of lighting apparatuses installed inside and outside the home.

The reflecting plate 4310 and the communication module 4320 may be covered by a cover unit 4330.

Figure 16:
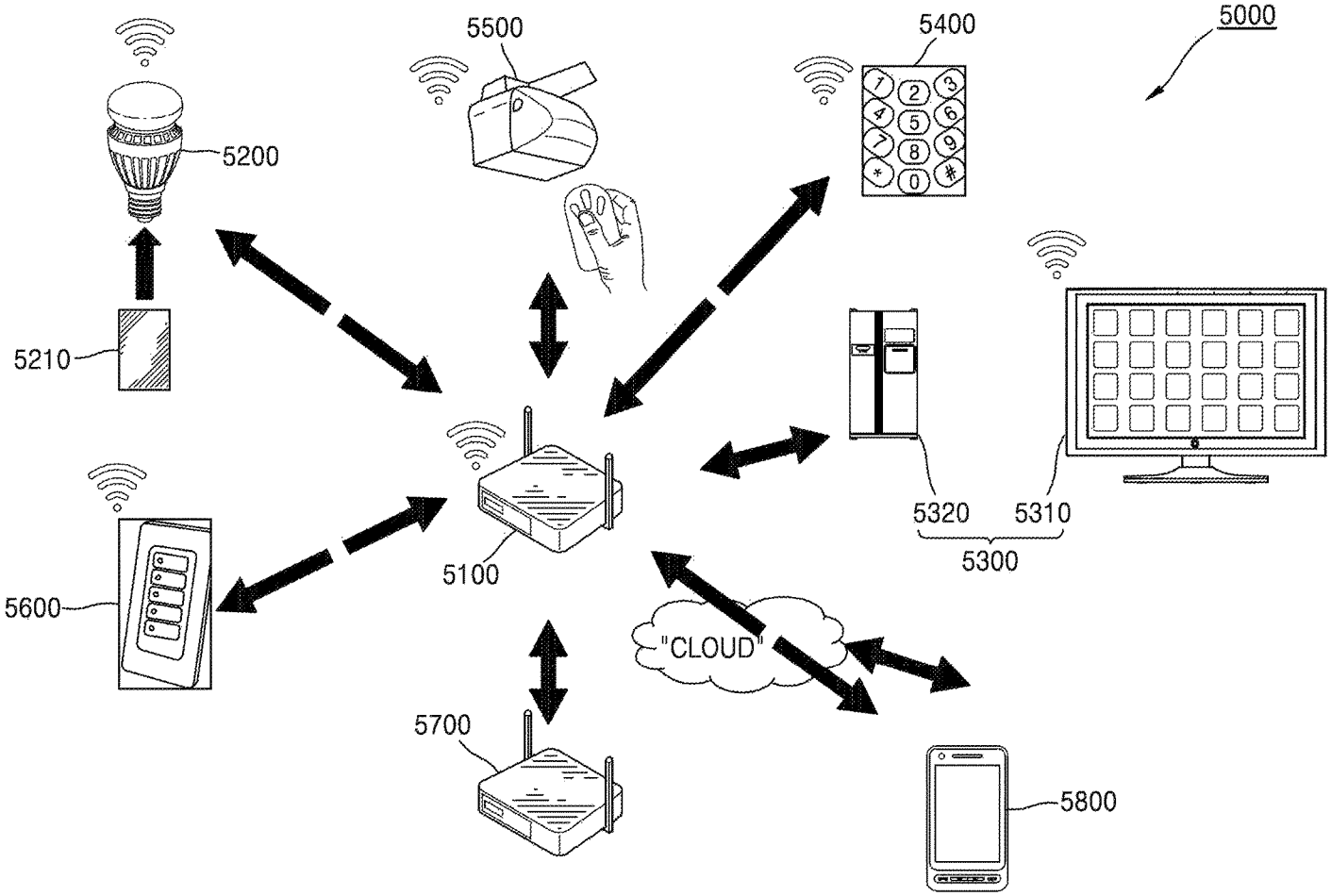
FIG. 16 is a diagram illustrating a network system for indoor lighting control.

FIG. 16 is a diagram illustrating a network system 5000 for indoor lighting control.

According to an embodiment of the present disclosure, the network system 5000 may be a complex smart lighting-network system that combines lighting technology using LEDs, Internet of Things (IoT) technology and wireless communication technology. The network system 5000 may be implemented by using various lighting apparatuses and wired/wireless communication apparatuses, and by software for sensors, controllers, communication devices, and controlling and maintaining networks.

The network system 5000 may be applied not only to a closed space defined in a building such as a home or an office, but also to an open space such as a park, a street, and the like. The network system 5000 may be implemented based on the IoT environment so that various information can be collected, processed, and provided to the user. In this exemplary embodiment, the LED lamp 5200 included in the network system 5000 may receive information about the surrounding environment from the gateway 5100 for controlling lighting of the LED lamp 5200 itself, and may perform functions such as checking and controlling the operation status of other devices (5300 through 5800) included in the IoT environment based on functions of visible light communication.

Referring to FIG. 16, the network system 5000 may include the gateway 5100 for processing data transceived via different communication protocols from each other, the LED lamp 5200 including LEDs and be connected to the gateway 5100 for communication, and a plurality of devices (5300 through 5800) connected to the gateway 5100 for communication via various wireless communication methods. Each of devices (5300 through 5800) and the LED lamp 5200 may include at least one communication module for implementing the network system 5000 based on the IoT environment. According to an embodiment, the LED lamp 5200 may be connected to the gateway 5100 for communication via wireless communication protocols such as WiFi, Zigbee, and LiFi, and to this end, may include at least one lamp communication module 5210.

As described above, the network system 5000 may be applied to the open space such as the street or the park as well as the closed space such as the home or the office. When the network system 5000 is applied to the home, the plurality of devices (5300 through 5800) which are included in the network system 5000 and connected to the gateway 5100 for communication based on the IoT technology network, may include home appliances 5300, digital door-locks 5400, garage door-locks 5500, lighting switches 5600 installed on walls, etc., routers 5700 as wireless communication network relays, and mobile devices 5800 such as smart phones, tablets, and laptop computers.

In the network system 5000, the LED lamp 5200 may use wireless communication network such as Zigbee, WiFi, and LiFi installed inside the home for verifying operation statuses of various devices (5300 through 5800) or automatically controlling brightness of the LED lamp 5200 itself with respect to surrounding environment/status. In addition, various devices (5300 through 5800) included in the network system 5000 may be controlled by using LiFi communication that utilizes visible rays emitted by the LED lamp 5200. The LED lamp 5200 may include the LED driving apparatuses (100, 100*a*, 100*b*, and 100*c*) in FIGS. 1, 7A, 10A, and 13, or the lighting apparatuses (10, 10*a*, 10*b*, and 10*c*) of FIGS. 1, 7A, 10A, and 13.

The LED lamp 5200 may automatically control brightness of the LED lamp 5200 based on surrounding environment transferred from the gateway 5100 via lamp communication module 5210, or the information about surrounding environment collected by sensors installed in the LED lamp 5200. For example, the brightness of the LED lamp 5200 may be automatically controlled depending on brightness of sorts of programs or screens on air in the TV 5310. To this end, the LED lamp 5200 may receive operation information of the TV 5310 from the lamp communication module 5210 connected to the gateway 5100. The lamp communication module 5210 may be modularized in unison with sensors and/or controllers included in the LED lamp 5200.

For example, when a TV program is a human drama, the lighting is lowered to a color temperature equal to or less than about 12000K, for example, 5000K in accordance with a predetermined value and colors may be adjusted to provide a cozy atmosphere. Alternatively, when the TV program is a gag program, the network system 5000 may be configured so that the color temperature is increased to about 5000K or higher with respect to predetermined brightness values and the brightness is controlled by blue color-based white light.

In addition, after a certain time passes after the digital door-lock 5400 has been locked with no person inside the home, all of turned-on LED lamps 5200 may be turned off and power waste may be prevented. Alternatively, when a security mode is established via the mobile devices 5800, etc. and the digital door-lock 5400 is locked with no person inside the home, the LED lamp 5200 may be maintained in a tuned-on state.

The operation of the LED lamp 5200 may be controlled with respect to surrounding environment collected by various sensors connected to the network system 5000. For example, when the network system 5000 is implemented inside a building, combination of lighting operations, location sensors, and communication modules inside the building and collection of location information of people inside the building may make it possible that the lighting is turned on or turned off, or management of facilities or idling spaces are efficiently utilized by providing collected information in real time. In general, since lighting devices such as the LED lamp 5200 are installed in almost all space on every floor inside the building, various kinds of information inside the building may be collected via sensors provided with the LED lamp 5200 in one body, and be utilized for facility management and utilization of idling spaces, and the like.

Alternatively, when the LED lamp 5200 is combined with image sensors, storing devices, the lamp communication module 5210, etc., the combined LED lamp 5200 may be used as a device to maintain building security or to detect and respond to emergencies. For example, when the LED lamp 5200 includes smoke or temperature sensors, damage may be minimized by promptly detecting the occurrence of a fire. In addition, the brightness of the lighting may be adjusted with respect to the outside weather, an amount of sunshine, etc so that energy can be saved and a pleasant lighting environment can be provided.

While the disclosure has been particularly shown and described with reference to embodiments thereof, it will be understood that various changes in form and details may be made therein without departing from the spirit and scope of the following claims.

What is claimed is:

1. A light-emitting diode (LED) driving apparatus driving an LED module including a first LED array having a first color temperature and a second LED array having a second color temperature different from the first color temperature, the LED driving apparatus comprising:

a first output circuit configured to supply a first driving current to the first LED array;

a second output circuit configured to supply a second driving current to the second LED array; and a controller including a lookup table that includes information about a first control signal corresponding to a first input signal and a second input signal and information about a second control signal corresponding to the first input signal and the second input signal, wherein the controller is configured to receive the first input signal and the second input signal from the outside of the LED driving apparatus, and to transmit the first control signal to the first output circuit and the second control signal to the second output circuit based on the information provided in the lookup table, wherein the controller is configured to control the LED module based on the first input signal so that color temperature of the LED module has a value between the first color temperature of the first LED array and the second color temperature of the second LED array, and to control brightness of the LED module based on the second input signal, wherein the controller is configured to receive signals comprising information about the first color temperature and the second color temperature from the outside of the LED driving apparatus, and to store in the lookup table information about the first control signal and the second control signal corresponding to the first input signal, based on the information about the first color temperature and the second color temperature, and wherein the controller is configured to select at least one third color temperature having a value between the first color temperature and the second color temperature, and to store in the lookup table a first range, a second range, and a third range of the first input signal respectively corresponding to the first color temperature, the second color temperature, and the at least one third color temperature.

2. The LED driving apparatus of claim 1, wherein information about the first control signal and the second control signal comprises information about a duty ratio of the first control signal and a duty ratio of the second control signal.

3. The LED driving apparatus of claim 2, wherein magnitude of the first driving current is proportionally related to the duty ratio of the first control signal and magnitude of the second driving current is proportionally related to the duty ratio of the second control signal.

4. The LED driving apparatus of claim 1, wherein the controller is configured to receive a table change signal from the outside of the LED driving apparatus and change the lookup table based on the table change signal.

5. A lighting apparatus comprising:

an LED module including a first LED array having a first color temperature and a second LED array having a second color temperature different from the first color temperature; and an LED driving apparatus configured to supply a first driving current to the first LED array and to supply a second driving current to the second LED array, wherein the LED driving apparatus is configured to receive a first input signal and a second input signal from the outside of the LED driving apparatus, to control a color temperature of the LED module to have a value between the first color temperature and the second color temperature based on the first input signal, and to control brightness of the LED module based on the second input signal, wherein the LED driving apparatus comprises:

a first output circuit configured to supply a first driving current to the first LED array;

a second output circuit configured to supply a second driving current to the second LED array; and a controller configured to receive the first input signal and the second input signal from the outside of the LED driving apparatus, and to transmit a first control signal to the first output circuit and a second control signal to the second output circuit, wherein the controller comprises a lookup table including information about a first control signal corresponding to a first input signal and a second input signal and information about a second control signal corresponding to the first input signal and the second input signal, wherein the controller is configured to transmit the first control signal to the first output circuit and the second control signal to the second output circuit based on the information provided in the lookup table, and when at least one of the first color temperature and the second color temperature is changed, the controller is configured to change the lookup table, based on the first color temperature after the change and the second color temperature after the change.

6. The lighting apparatus of claim 5, wherein the controller is configured to control a duty ratio of the first control signal and a duty ratio of the second control signal based on the information provided in the lookup table.

7. The lighting apparatus of claim 6, wherein magnitude of the first driving current is proportionally related to the duty ratio of the first control signal and magnitude of the second driving current is proportionally related to the duty ratio of the second control signal.

8. The lighting apparatus of claim 5, wherein the controller is configured to select at least one third color temperature having a value between the first color temperature and the second color temperature after the change, and to store in the lookup table a first range, a second range, and a third range respectively corresponding to the first color temperature after the change, the second color temperature after the change, and the at least one third color temperature after the change.

9. The lighting apparatus of claim 5, wherein, after a table change signal from the outside of the LED driving apparatus is received, the controller is configured to delete information about the first control signal and the second control signal corresponding to a partial range of the first input signal from the lookup table.

10. The lighting apparatus of claim 5, wherein the LED module comprises a photo sensor configured to measure the first color temperature, the second color temperature, brightness of the first LED array, and brightness of the second LED array.

11. The lighting apparatus of claim 10, wherein the LED driving apparatus is configured to receive from the photo sensor a signal comprising information about the first color temperature, the second color temperature, a maximum brightness of the first LED array, and a maximum brightness of the second LED array.

12. The lighting apparatus of claim 5, wherein the LED driving apparatus is configured to supply the first driving current and the second driving current so that the color temperature of the LED module increases as a value of the first input signal increases.

13. The lighting apparatus of claim 5, wherein a plurality of first LED elements included in the first LED array and a plurality of second LED elements included in the second LED array are alternately arranged with each other.

14. A method of driving an LED module including a first LED array having a first color temperature and a second LED array having a second color temperature different from the first color temperature, the method of driving the LED module comprising:

receiving a calibration request signal;

receiving a signal including information about the first color temperature and the second color temperature;

storing, into a lookup table included in an LED driving apparatus, information about a first control signal corresponding to a first input signal and a second input signal and information about a second control signal corresponding to the first input signal and the second input signal;

receiving the first input signal and the second input signal;

generating the first control signal and the second control signal based on the information provided in the lookup table;

controlling the LED module based on the first input signal so that color temperature of the LED module has a value between the first color temperature of the first LED array and the second color temperature of the second LED array while maintaining brightness of the LED module; and controlling brightness of the LED module based on the second input signal, wherein the storing comprises selecting a portion of a color temperature range between the first color temperature and the second color temperature; and storing, into the lookup table, information about the first control signal and the second control signal corresponding to the first input signal, based on the selected portion of the color temperature range.

* * * * *